US009524664B2

(12) United States Patent
Furihata et al.

(10) Patent No.: US 9,524,664 B2
(45) Date of Patent: Dec. 20, 2016

(54) DISPLAY DEVICE, DISPLAY PANEL DRIVER AND DRIVE METHOD OF DISPLAY PANEL

(71) Applicant: Synaptics Display Devices GK, Tokyo (JP)

(72) Inventors: Hirobumi Furihata, Tokyo (JP); Takashi Nose, Tokyo (JP); Akio Sugiyama, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 167 days.

(21) Appl. No.: 14/617,738

(22) Filed: Feb. 9, 2015

(65) Prior Publication Data

US 2015/0302789 A1 Oct. 22, 2015

(30) Foreign Application Priority Data

Feb. 10, 2014 (JP) ..... 2014-023874

(51) Int. Cl.
*G09G 3/20* (2006.01)
*G09G 3/36* (2006.01)

(52) U.S. Cl.
CPC ..... *G09G 3/2007* (2013.01); *G09G 3/2092* (2013.01); *G09G 3/3611* (2013.01); *G09G 2320/0276* (2013.01); *G09G 2320/066* (2013.01); *G09G 2320/0673* (2013.01); *G09G 2360/16* (2013.01)

(58) Field of Classification Search
CPC ..... G09G 2300/0452; G09G 3/3607; G09G 2340/0457; G09G 3/2003
See application file for complete search history.

(56) References Cited

U.S. PATENT DOCUMENTS

| | | | |
|---|---|---|---|
| 6,760,484 | B1 | 7/2004 | Sobol |
| 6,771,814 | B1 | 8/2004 | Nakajima |
| 7,973,973 | B2 | 7/2011 | Nose et al. |
| 2008/0252791 | A1 | 10/2008 | Mitsunaga |

(Continued)

FOREIGN PATENT DOCUMENTS

| | | |
|---|---|---|
| JP | H7-170428 | 4/1995 |
| JP | 2010-278937 A | 12/2010 |
| WO | 2006-018658 A2 | 2/2006 |

*Primary Examiner* — Kumar Patel
*Assistant Examiner* — Mansour M Said
(74) *Attorney, Agent, or Firm* — Patterson + Sheridan, LLP

(57) ABSTRACT

A display device includes a display panel and a driver. The driver generates APL-calculation image data corresponding to an APL-calculation luminance image through an APL-calculation filtering process on the input usage data, calculates area characterization data including first APL data of each area in the APL-calculation luminance image and calculates second APL data depending on the position of each pixel and the first APL data of the area characterization data associated with the area in which each pixel is located and with the adjacent areas to generate pixel-specific characterization data including the second APL data. The driver generates output image data on the basis of the second APL data of the pixel-specific image data and drives each pixel in response to the output image data. The APL-calculating filtering process involves setting a luminance value of the target pixel in the APL-calculation luminance image to a specific APL-calculation alternative luminance value.

16 Claims, 22 Drawing Sheets

(56) References Cited

U.S. PATENT DOCUMENTS

| | | | | |
|---|---|---|---|---|
| 2010/0039451 | A1* | 2/2010 | Jung | G09G 3/3611 345/690 |
| 2010/0321581 | A1* | 12/2010 | Iwakura | G09G 3/288 348/687 |
| 2011/0122168 | A1* | 5/2011 | Lee | G09G 3/3426 345/690 |

* cited by examiner

DISPLAY DEVICE, DISPLAY PANEL DRIVER AND DRIVE METHOD OF DISPLAY PANEL

CROSS REFERENCE

This application claims priority of Japanese Patent Application No. 2014-023874, filed on Feb. 10, 2014, the disclosure which is incorporated herein by reference.

TECHNICAL FIELD

The present relates to a panel display device, a display panel driver and a method of driving a display panel, more particularly, to an apparatus and method for correction of image data in a panel display device.

BACKGROUND ART

The auto contrast optimization (ACO) is one of widely-used techniques for improving display qualities of panel display devices such as liquid crystal display devices. For example, contrast enhancement of a dark image under a situation in which the brightness of a backlight is desired to be reduced effectively suppresses deterioration of the image quality with a reduced power consumption of the liquid crystal display device. In one approach, the contrast enhancement may be achieved by performing a correction calculation on image data (which indicate grayscale levels of each subpixel of each pixel). Japanese Patent Gazette No. 4,198,720 B2 discloses a technique for achieving a contrast enhancement, for example.

An auto contrast enhancement is most typically achieved by analyzing image data of the entire image and performing a common correction calculation for all the pixels in the image on the basis of the analysis; however, according to an inventors' study, such auto contrast enhancement may cause a problem that, when a strong contrast enhancement is performed, the number of representable grayscale levels is reduced in dark and/or bright regions of images. A strong contrast enhancement potentially causes so-called "blocked up shadows" (that is, a phenomenon in which an image element originally to be displayed with a grayscale representation is undesirably displayed as a black region with a substantially-constant grayscale level) in a dark region in an image, and also potentially causes so-called "clipped white" in a bright region in an image.

One known approach to address such problem is local contrast correction. For example, Japanese Patent Application Publication No. 2001-245154 A discloses a local contrast correction. In the technique disclosed in this patent document, a small difference in the contrast between individual regions in the original image is maintained while the maximum difference in the contrast between the individual regions is restricted.

One known technique for a local contrast correction is to perform contrast correction of respective positions of tine image in response to the difference between the original image and an image obtained by applying low-pass filtering to image data. Such technology is disclosed, for example, in Japanese Patent Application Publications Nos. 2008-263475 A, H07-170428 A and 2008-511048 A. The technique using low-pass filtering, however, causes a problem of an increased circuit size, since this technique requires a memory for storing an image obtained by the low-pass filtering.

Another known technique for a local contrast correction is to perform a contrast correction of each area defined in the image of interest on the basis of the image characteristics of each area. Such technology is disclosed, for example, in Japanese Patent Application Publications Nos. 2001-113754 A and 2010-278937 A. In the technique disclosed in these patent document, a contrast correction suitable for each area is achieved by setting the input-output relation of input image data and corrected image data (image data obtained by performing contrast correction on the input image data) for pixels of each area on the basis of the image characteristics of each area.

The technique which performs a contrast correction of each area defined in the image on the basic of the image characteristics of each area may undesirably cause discontinuities in the displayed image at boundaries between adjacent areas. Such discontinuities in the displayed image may be undesirably observed as block noise.

In the technique disclosed in Japanese Patent Application Publications No. 2010-278937 A, the input-output relation of input image data and corrected image data is continuously modified to resolve such discontinuities in the displayed image (refer to FIG. 1). This technique, however, may undesirably cause a halo effect when an image including a constant-color region near an image edge (for example, an image including a display window) is displayed.

FIG. 1 is a conceptual diagram illustrating an example of the halo effect. FIG. 1 illustrates an example of occurrence of a halo effect in a technique in which the gamma value of a gamma curve used for contrast correction is determined on the basis of the average picture level (APL) of each area. It should be noted that the gamma curve is a curve specifying the input-output relation between input image data and corrected image data.

For example, let us consider the case when input image data of an image including a first region of a constant color with a luminance value of 200 and a second region of a constant color with a luminance value of 20 are provided and areas arrayed in two rows and two columns are defined in the image, and the APLs of the areas are calculated as 155, 110, 110 and 20, respectively, as illustrated in FIG. 1. When a gamma value of $\gamma_A$ is determined with respect to position A in the area with an APL of 150 and a gamma value of $\gamma_B$ is determined with respect to position B in an area with an APL of 110, the gamma value is determined so as to continuously modified between positions A and B with the technique in which the input-output relation between the input image data and the corrected image data is continuously modified; however, the continuous modification of the gamma value results in that the finally-obtained grayscale levels of the respective colors indicated in the corrected image data are different even if the input image data indicates the constant grayscale levels of the respective colors. This is undesirably observed as a halo effect.

FIG. 2 schematically illustrates an image which experiences a halo effect. Let use consider the case when the original image (illustrated in FIG. 2(*a*)) is an image in which a rectangular window 102 with a constant color is superposed on a background 101 with a constant color. In this case, it would be desirable that the image obtained by the contrast correction (FIG. 2(*b*)) is also displayed as an image in which the rectangular window 102 with a constant color is superposed on the background 101 with a constant color; however, the use of the technique in which the input-output relation between the input image data and the corrected image data is continuously modified undesirably results in that an halo effect is observed in which a gradation occurs near the edges of the rectangular window 102, as illustrated in FIG. 2(*c*).

As thus discussed, there is a need for providing a technique which effectively reduces a discontinuity in the display region at edges of areas in a contrast correction based on the image characteristics of respective areas defined in the image, while suppressing occurrence of a halo effect.

SUMMARY OF INVENTION

Disclosed herein are display devices, display panel drivers and a method for driving a display panel. In one example, a display device is provided that includes a display panel and a driver. The display panel includes a display region, wherein a plurality of areas are defined in the display region. The driver is configured to drive each pixel in the display region in response to input image data. The driver is additionally configured to (1) generate APL-calculation image data corresponding to an APL-calculation luminance image by performing an APL-calculating filtering process on the input image data; (2) calculate area characterization data including first APL data indicating an average picture level of each of the areas in the APL-calculation luminance image for each of the areas, from the APL-calculation image data; (3) calculate second APL data for each pixel depending on a position of each pixel and the first APL data of the area characterization data associated with the area in which each pixel is located and with areas adjacent to the area in which each pixel is located, and generate pixel-specific characterization data including the second APL data for each pixel; (4) generate output image data associated with each pixel by performing a correction calculation based on the second APL data of the pixel-specific image data associated with each pixel; and (5) drive each pixel in response to the output image data associated with each pixel. The APL-calculating filtering process for a target pixel of the pixels in the display region includes setting a luminance value of the target pixel in the APL-calculation luminance image to a specific APL-calculation alternative luminance value in response to differences of a luminance value of the target pixel from those of pixels near the target pixel in a luminance image corresponding to the input image data.

In another example, a display panel driver for driving each pixel in a display region of a display panel in response to input image data is provided. The display region includes a plurality of areas are defined therein. The driver includes an area characterization data calculation section, a pixel-specific characterization data calculation section, correction circuitry, and drive circuitry. The area characterization data calculation section is operable to generate APL-calculation image data corresponding to an APL-calculation luminance image by performing an APL-calculating filtering process on the input image data, and calculates area characterization data including first APL data indicating an average picture level of each of the areas in the APL-calculation luminance image for each of the areas, from the APL-calculation image data. The pixel-specific characterization data calculation section is operable to calculate second APL data for each pixel depending on the position of each pixel and the first APL data of the area characterization data associated with the area in which each pixel is located and with areas adjacent to the area in which each pixel is located to generate pixel-specific characterization data including the second APL data for each pixel. The correction circuitry is operable to generate output image data associated with each pixel by performing a correction calculation based on the second APL data of the pixel-specific image data associated with each pixel. The drive circuitry is operable to drive each pixel in response to the output image data associated with each pixel. The APL-calculating filtering process for a target pixel of the pixels in the display region includes setting a luminance value of the target pixel in the APL-calculation luminance image to a specific APL-calculation alternative luminance value in response to differences of a luminance value of the target pixel from those of pixels near the target pixel in a luminance image corresponding to the input image data.

In another example, a display panel drive method for driving each pixel in a display region of a display panel in response to input image data is provided. The display panel drive method includes generating APL-calculation image data corresponding to an APL-calculation luminance image by performing an APL-calculating filtering process on the input image data; calculating area characterization data including first APL data indicating an average picture level of each of the areas in the APL-calculation luminance image for each of the areas, from the APL-calculation image data; calculating second APL data for each pixel depending on the position of each pixel and the first APL data of the area characterization data associated with the area in which each pixel is located and with areas adjacent to the area in which each pixel is located to generate pixel-specific characterization data including the second APL data for each pixel; generating output image data associated with each pixel by performing a correction calculation based on the second APL data of the pixel-specific image data associated with each pixel; and driving each pixel in response to the output image data associated with each pixel. The APL-calculating filtering process for a target pixel of the pixels in the display region includes setting a luminance value of the target pixel in the APL-calculation luminance image to a specific APL-calculation alternative luminance value in response to differences of a luminance value of the target pixel from those of pixels near the target pixel in a luminance image corresponding to the input image data.

BRIEF DESCRIPTION OF THE DRAWINGS

The above and other advantages and features of the present invention will be more apparent from the following description taken in conjunction with the accompanied drawings, in which.

DETAILED DESCRIPTION

Figure 1:
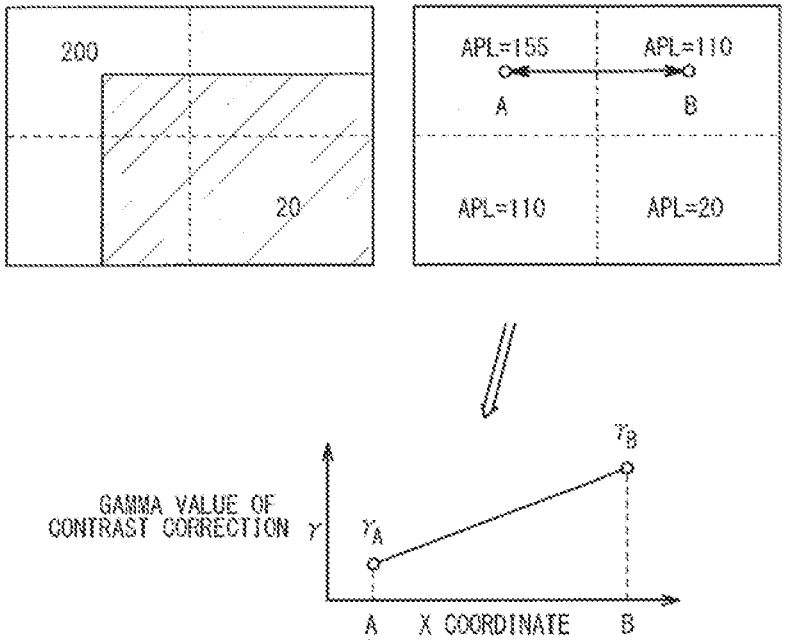
FIG. 1 is a diagram illustrating an example of generation of a halo effect in a technique in which the gamma value of a gamma curve used for contrast correction is determined on the basis of the average picture level (APL) of each area.

The invention will be now described herein with reference to illustrative embodiments. Those skilled in the art would recognize that many alternative embodiments can be accomplished using the teachings of the present invention and that the invention is not limited to the embodiments illustrated for explanatory purposed.

Introduction

Therefore, an objective of the present invention is to provide a technique which effectively reduces a discontinuity in the display region at edges of areas in a contract correction based on the image characteristics of respective areas defined in the image, while suppressing occurrence of a halo effect.

Other objectives and new features of the present invention would be understood from the disclosure in the Specification and attached drawings.

In an aspect of the present invention, a display device includes: a display panel including a display region; and a driver driving each pixel in the display region in response to input image data. A plurality of areas are defined in the display region. The driver is configured: to generate APL-calculation image data corresponding to an APL-calculation luminance image by performing an APL-calculating filtering process on the input image data and to calculate area characterization data including first APL data indicating an average picture level of each of the areas in the APL-calculation luminance image for each of the areas, from the APL-calculation image data. The driver is further configured to calculate second APL data for each pixel depending on the position of each pixel and the first APL data of the area characterization data associated with the area in which each pixel is located and with areas adjacent to the area in which each pixel is located, and to generate pixel-specific characterization data including the second APL data for each pixel. The driver is further configured to generate output image data associated with each pixel by performing a correction calculation based on the second APL data of the pixel specific image data associated with each pixel and to drive each pixel in response to the output image data associated with each pixel. The APL-calculating filtering process for a target pixel of the pixels in the display region involves setting a luminance value of the target pixel in the APL-calculation luminance image to a specific APL-calculation alternative luminance value in response to differences of a luminance value of the target pixel from those of pixels near the target pixel in a luminance image corresponding to the input image data.

In a preferred embodiment, the driver is configured to generate square-mean-calculation image data corresponding to a square-mean-calculation luminance image by performing a square-mean-calculating filtering process on the input image data. In this case, the area characterization data include square-mean data indicating a mean of squares of luminance values of pixels in each of the areas in the square-mean-calculation luminance image, and the pixel-specific characterization data include variance data which depend on the position of each pixel and the square-mean data of the area characterization data associated with the area in which each pixel is located and with areas adjacent to the area in which each pixel is located. The driver is configured to determine a gamma value of a gamma curve for each pixel based on the second APL data of the pixel-specific characterization data associated with each pixel, and to perform an operation for modifying a shape of the gamma curve for each pixel, based on the variance data of the pixel-specific characterization data associated with each pixel. The square-mean-calculating filtering process for the target pixel involves setting a luminance value of the target pixel in the square-mean-calculation luminance image to a specific square-mean-calculation alternative luminance value in response to differences of the luminance value of the target pixel from those of pixels near the target pixels in the luminance image corresponding to the input image data.

In another aspect of the present invention, a display panel driver is provided for driving each pixel in a display region of a display panel in response to input image data. A plurality of areas are defined in the display region. The driver includes: an area characterization data calculation section which generates APL-calculation image data corresponding to an APL-calculation luminance image by performing an APL-calculating filtering process on the input image data, and calculates area characterization data including first APL data indicating an average picture level of each of the areas in the APL-calculation luminance image for each of the areas, from the APL-calculation image data; a pixel-specific characterization data calculation section which calculates second APL data for each pixel depending on the position of each pixel and the first APL data of the area characterization data associated with the area in which each pixel is located and with areas adjacent to the area in which each pixel is located to generate pixel-specific characterization data including the second APL data for each pixel; a correction circuitry which generates output image data associated with each pixel by performing a correction calculation based on the second APL data of the pixel-specific image data associated with each pixel; and a drive circuitry which drives each pixel in response to the output image data associated with each pixel. The APL-calculating filtering process for a target pixel of the pixels in the display region involves setting a luminance value of the target pixel in the APL-calculation luminance image to a specific APL-calculation alternative luminance value in response to differences of a luminance value of the target pixel from those of pixels near the target pixel in a luminance image corresponding to the input image data.

In a preferred embodiment, the area characterization data calculation section generates square-mean-calculation image data corresponding to a square-mean-calculation luminance image by performing a square-mean-calculating filtering process on the input image data. The area characterization data include square-mean data indicating a mean of squares of luminance values of pixels in each of the areas in the square-mean-calculation luminance image, and the pixel-specific characterization data include variance data which depend on the position of each pixel and the square-mean data of the area characterization data associated with the area in which each pixel is located and with areas adjacent to the area in which each pixel is located. The correction circuitry determines a gamma value of a gamma curve for each pixel based on the second APL data of the pixel-specific characterization data associated with each pixel, and performs an operation for modifying a shape of the gamma curve for each pixel, based on the variance data of the pixel-specific characterization data associated with each pixel. The square-mean-calculating filtering process for the target pixel involves setting a luminance value of the target pixel in the square-mean-calculation luminance image to a specific square-mean-calculation alternative luminance value in response to differences of the luminance value of the target pixel from those of pixels near the target pixels in the luminance image corresponding to the input image data.

In another aspect of the present invention, a A display panel drive method is provided for driving each pixel in a display region of a display panel in response to input image data. The method includes: generating APL-calculation image data corresponding to an APL-calculation luminance image by performing an APL-calculating filtering process on the input image data; calculating area characterization data including first APL data indicating an average picture level of each of the areas in the APL-calculation luminance image for each of the areas, from the APL-calculation image data; calculating second APL data for each pixel depending on the position of each pixel and the first APL data of the area characterization data associated with the area in which each pixel is located and with areas adjacent to the area in which each pixel is located to generate pixel-specific characterization data including the second APL data for each pixel; generating output image data associated with each pixel by performing a correction calculation based on the second APL data of the pixel-specific image data associated with each pixel; and driving each pixel in response to the output image data associated with each pixel. The APL-calculating filtering process for a target pixel of the pixels in the display region involves setting a luminance value of the target pixel in the APL-calculation luminance image to a specific APL-calculation alternative luminance value in response to differences of a luminance value of the target pixel from those of pixels near the target pixel in a luminance image corresponding to the input image data.

In one preferred embodiment, the drive method further includes: generating square-mean-calculation image data corresponding to a square-mean-calculation luminance image by performing a square-mean-calculating filtering process on the input image data. In this case, the area characterization data include square-mean data indicating a mean of squares of luminance values of pixels in each of the areas in the square-mean-calculation luminance image, and the pixel-specific characterization data include variance data which depend on the position of each pixel and the square-mean data of the area characterization data associated with the area in which each pixel is located and with areas adjacent to the area in which each pixel is located. In the step of generating the output image data, a gamma value of a gamma curve for each pixel is determined on the basis of the second APL data of the pixel-specific characterization data associated with each pixel, and the shape of the gamma curve for each pixel is modified on the basis of the variance data of the pixel-specific characterization data associated with each pixel. The square-mean-calculating filtering process for the target pixel involves setting a luminance value of the target pixel in the square-mean-calculation luminance image to a specific square-mean-calculation alternative luminance value in response to differences of the luminance value of the target pixel from those of pixels near the target pixels in the luminance image corresponding to the input image data.

The present invention effectively reduces a discontinuity in the display region at edges of areas in a contrast correction based on the image characteristics of respective areas defined in the image, while suppressing occurrence of a halo effect.

Discussion

Figure 3:
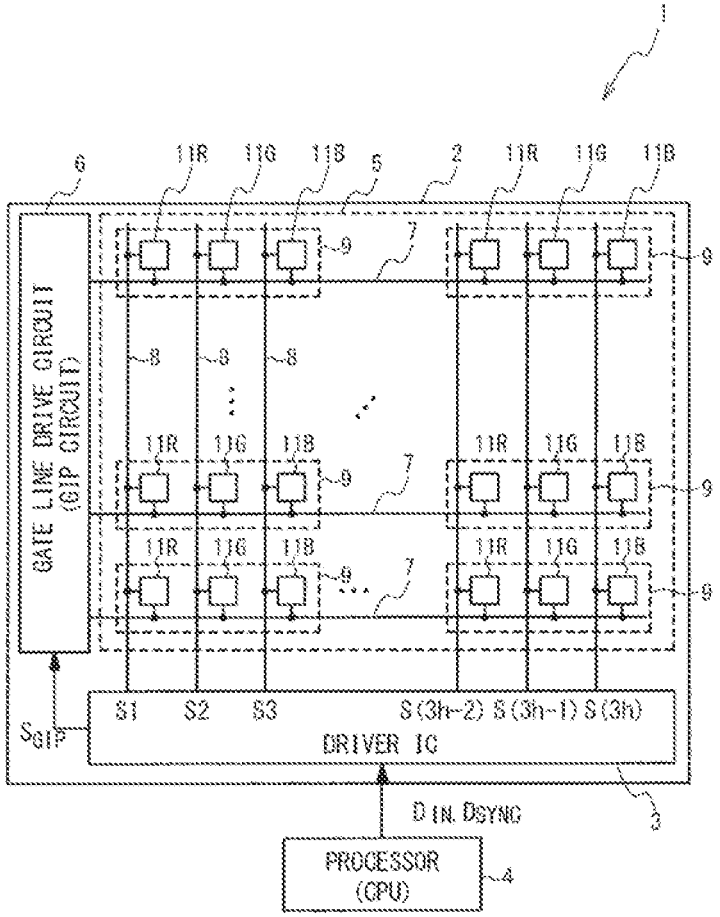
FIG. 3 is a block diagram illustrating an exemplary configuration of a panel display device in one embodiment of the present invention.

FIG. 3 is a block diagram illustrating an exemplary configuration of a panel display device in one embodiment of the present invention. The panel display device in the present embodiment, which is configured as a liquid crystal display device denoted by numeral 1, includes an LCD (liquid crystal display) panel 2, a driver IC (integrated circuit) 3.

The LCD panel 2 includes a display region 5 and a gate line drive circuit 6 (also referred to as gate-in-panel (GIP) circuit). Disposed in the display region 5 are a plurality of gate lines 7 (also referred to as scan lines or address lines), a plurality of data lines 8 (also referred to as signal lines or source lines) and a plurality of pixels 9. In the present embodiment, the number of the gate lines 7 is v, the number of the data lines 8 is 3h and the pixels 9 are arrayed in v rows and h columns, where v and h are integers equal to or more than two. In the following, the horizontal direction of the display region 5 (that is, the direction in which the gate lines 7 are extended) may be referred to as X-axis direction and the vertical direction of the display region 5 (that is, the direction in which the data lines 8 are extended) may be referred to as Y-axis direction.

In the present embodiment, each pixel 9 includes three subpixels: an R subpixel 11R, a G subpixel 11G and a B subpixel 11B, where the R subpixel 11R is a subpixel corresponding to a red color (that is, a subpixel displaying a red color), the G subpixel 11G is a subpixel corresponding to a green color (that is, a subpixel displaying a green color)

and the B subpixel 11B is a subpixel corresponding to a blue, color (that is, a subpixel displaying a blue color). Note that the R subpixel 11R, G subpixel 11G and B subpixel 11B may be collectively referred to as subpixel 11 if not distinguished from each other. In the present embodiments subpixels 11 are arrayed in v rows and 3h columns on the LCD panel 2. Each subpixel 11 is connected with one corresponding gate line 7 and one corresponding data line 8. In driving respective subpixels 11 of the LCD panel 2, gate lines 7 are sequentially selected and desired drive voltages are written into the subpixels 11 connected with a selected gate line 7 via the data lines 8. This allows setting the respective subpixels 11 to desired grayscale levels to thereby display a desired image in the display region 5 of the LCD panel 2.

Figure 4:
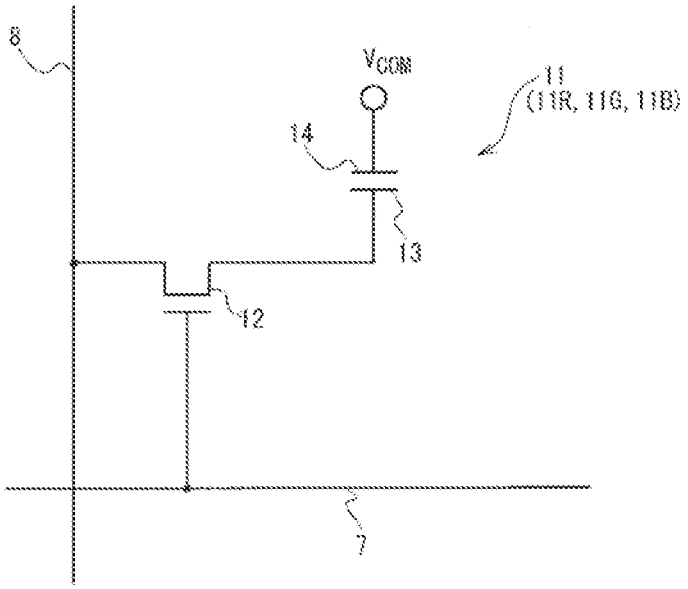
FIG. 4 is a circuit diagram schematically illustrating the configuration of each subpixel.

FIG. 4 is a circuit diagram schematically illustrating the configuration of each subpixel 11. Each subpixel 11 includes a TFT (thin film transistor) 12 and a pixel electrode 13. The TFT 12 has a gate connected with a gate line 7, a source connected with a data line 8 and a drain connected with the pixel electrode 13. The pixel electrode 13 is opposed to the opposing electrode (common electrode) 14 of the LCD panel 2 and the space between each pixel electrode 13 and the opposing electrode 14 is filled with liquid crystal. Although FIG. 4 illustrates the subpixel 11 as if the opposing electrode 14 may do separately disposed for each subpixel 11, a person skilled in the art would appreciate that the opposing electrode 14 is actually shared by the subpixels 11 of the entire LCD panel 2.

Referring back to FIG. 3, the driver IC 3 drives the data lines 8 and also generates gate line control signals $S_{GIP}$ for controlling the gate line drive circuit 6. The drive of the data lines 8 is responsive to input image data $D_{IN}$ and synchronization data $D_{SYNC}$ received from a processor 4 (for example, a CPU (central processing unit)). It should be noted here that the input image data $D_{IN}$ are image data corresponding to images to be displayed in the display region 5 of the LCD panel 2, more specifically, data indicating the grayscale levels of each subpixel 11 of each pixel 9. In the present embodiment, the input image data $D_{IN}$ represent the grayscale level of each subpixel 11 of each pixel 9 with eight bits. In other words, the input image data $D_{IN}$ represent the grayscale levels of each pixel 9 of the LCD panel 2 with 24 bits. In the following, data indicating the grayscale level of an R subpixel 11R of input image data $D_{IN}$ may be referred to as input image data $D_{IN}^R$. Correspondingly, data indicating the grayscale level of a G subpixel 11G of input image data $D_{IN}$ may be referred to as input image data $D_{IN}^G$ and data indicating the grayscale level of a B subpixel 11B of input image data $D_{IN}$ may be referred to as input image data $D_{IN}^B$. The synchronization data $D_{SYNC}$ are used to control the operation timing of the driver IC 3; the generation timing of various timing control signals in the driver IC 3, including the vertical synchronization signal $V_{SYNC}$ and the horizontal synchronization signal $H_{SYNC}$, is controlled in response to the synchronization data $D_{SYNC}$. Also, the gate line control signals $S_{GIP}$ are generated in response to the synchronization data $D_{SYNC}$. The driver IC 3 is mounted on the LCD panel 2 with a surface mounting technology such as a COG (chip on glass) technology.

Figure 5:
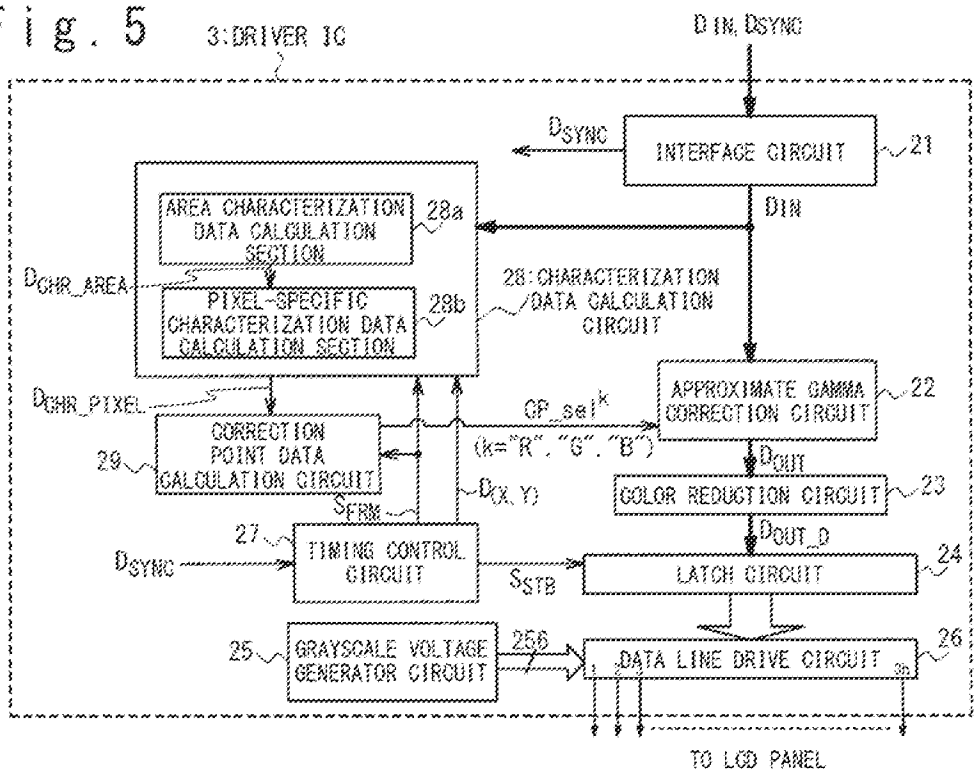
FIG. 5 is a block diagram illustrating an example of the configuration of the driver IC in the present embodiment.

FIG. 5 is a block diagram illustrating an example of the configuration of the driver IC 3. The driver IC 3 includes an interface circuit 21, an approximate gamma correction circuit 22, a color reduction circuit 23, a latch circuit 24, a grayscale voltage generator circuit 25, a data line drive circuit 26, a timing control circuit 27, a characterization data calculation circuit 28 and a correction point data calculation circuit 29.

The interface circuit 21 receives the input image data $D_{IN}$ and synchronization data $D_{SYNC}$ from the processor 4 and forwards the input image data $D_{IN}$ to the approximate gamma correction circuit 22 and the synchronization data $D_{SYNC}$ to the timing control circuit 27.

The approximate gamma correction circuit 22 performs a correction calculation (or gamma correction) on the input image data $D_{IN}$ in accordance with a gamma curve specified by correction point data set $CP_sel^k$ received from the correction point data calculation circuit 29, to thereby generate output image data $D_{OUT}$. In the following, data indicating the grayscale level of an R subpixel 11R of the output image data $D_{OUT}$ may be referred to as output image data $D_{OUT}^R$. Correspondingly, data indicating the grayscale level of a G subpixel 11G of the output image data $D_{OUT}$ may be referred to as output image data $D_{OUT}^G$ and data indicating the grayscale level of a B subpixel 11B of the output image data $D_{OUT}$ may be referred to as output image data $D_{OUT}^B$.

The number of bits of the output image data $D_{OUT}$ is larger than that of the input image data $D_{IN}$. This effectively avoids losing information of the grayscale levels of pixels in the correction calculation. In the present embodiment, in which the input image data $D_{IN}$ represent the grayscale level of each subpixel 11 of each pixel 9 with eight bits, the output image data $D_{OUT}$ may be, for example, generated as data that represent the grayscale level of each subpixel 11 of each pixel 9 with 10 bits.

Although a gamma correction is most typically achieve with an LUT (lookup table), the gamma correction performed by the approximate gamma correction circuit 22 in the present embodiment is achieved with an arithmetic expression, without using an LUT. The exclusion of an LUT from the approximate gamma correction circuit 22 effectively allows reducing the circuit size of the approximate gamma correction circuit 22 and also reducing the power consumption necessary for switching the gamma value. It should be noted however that the approximate gamma correction circuit 22 uses an approximate expression, not the exact expression, for achieving the gamma correction in the present embodiment. The approximate gamma correction circuit 22 determines coefficients of the approximate expression used for the gamma correction in accordance with a desired gamma curve to achieve a gamma correction with a desired gamma value. A gamma correction with the exact expression requires a calculation of an exponential function and this undesirably increases the circuit size. In the present embodiment, in contrast, the gamma correction is achieved with an approximate expression which does not include an exponential function to thereby reduce the circuit size.

The shapes of the gamma curves used in the gamma correction performed by the approximate gamma correction circuit 22 are specified by correction point data sets $CP_sel^R$, $CP_sel^G$ or $CP_sel^B$. To perform gamma corrections with different gamma values for the R subpixel 11R, G subpixel 11G and B subpixel 11B of each pixel 9, different correction point data sets are respectively prepared for the R subpixel 11R, G subpixel 11G and B subpixel 11B of each pixel 9 in the present embodiment. The correction point data set $CP_sel^R$ is used for a gamma correction of input image data $D_{IN}^R$ associated with an R subpixel 11R. Correspondingly, the correction point data set $CP_sel^G$ is used for a gamma correction of input image data $D_{IN}^G$ associated with a G subpixel 11G and the correction point data set $CP_sel^B$ is used for a gamma correction of input image data $D_{IN}^B$ associated with a B subpixel 11B.

Figure 6:
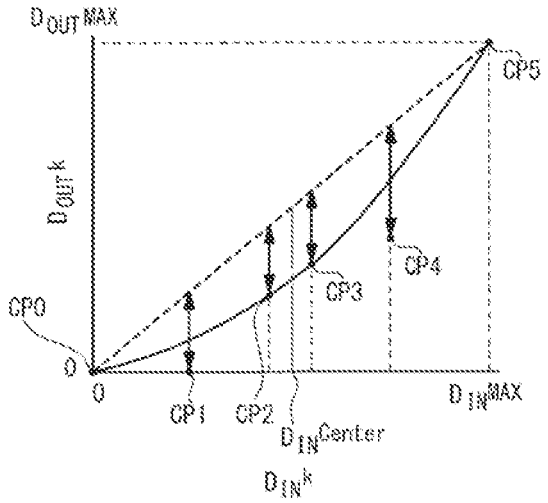
FIG. 6 illustrates a gamma curve specified by each correction point data set and contents of the gamma correction in accordance with the gamma curve.

FIG. 6 illustrates the gamma curve specified by each correction point data set $CP_sel^k$ and contents of the gamma correction in accordance with the gamma curve. Each correction point data set $CP_sel^k$ includes correction point data CP0 to CP5. The correction point data CP0 to CP5 are each defined as data indicating a point in a coordinate system in which input image data $D_{IN}^k$ are associated with the horizontal axis (or a first axis) and output image data $D_{OUT}^k$ are associated with the vertical axis (or a second axis). The correction point data CP0 and CP5 respectively indicate the positions of correction points, which may be also denoted by numerals CP0 and CP5, defined at the both ends of the gamma curve. The correction point data CP2 and CP3 respectively indicate the positions of correction points which are also denoted by numerals CP2 and CP3 and defined on an intermediate section of the gamma curve. The correction point data CP1 indicate the position of a correction point which is also denoted by numeral CP1 and located between the correction points CP0 and CP2 and the correction point data CP4 indicate the position of a correction point CP4 which is also denoted by numeral CP4 and located between the correction points CP3 and CP5. The shape of the gamma curve is specified by appropriately determining the positions of the correction points CP1 to CP4 indicated by the correction point data CP1 to CP4.

As illustrated in FIG. 6, for example, it is possible to specify the shape of the gamma curve as being convex downward by determining the positions of the correction points CP1 to CP4 as being lower than the straight line connecting the both ends of the gamma curve. The approximate gamma correction circuit 22 generates the output image data $D_{OUT}^k$ by performing a gamma correction in accordance with the gamma curve with the shape specified by the correction point data CP0 to CP5 included in the correction point data set $CP_sel^k$.

Figure 7:
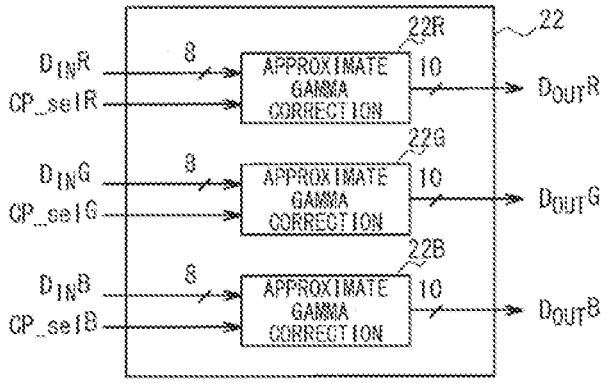
FIG. 7 is a block diagram illustrating an example of the configuration of the approximate gamma correction circuit in the present embodiment.

FIG. 7 is a block diagram illustrating an example of the configuration of the approximate gamma correction circuit 22. The approximate gamma correction circuit 22 includes approximate gamma correction units 22R, 22G and 22B, which are prepared for R subpixels 11R, G subpixels 11G and B subpixels 11B, respectively. The approximate gamma correction units 22R, 22G and 22B each perform a gamma correction with an arithmetic expression on the input image data $D_{IN}^R$, $D_{IN}^G$ and $D_{IN}^B$, respectively, to generate the output image data $D_{OUT}^R$, $D_{OUT}^G$ and $D_{OUT}^B$, respectively. As described above, the number of bits of the output image data $D_{OUT}^R$, $D_{OUT}^G$ and $D_{OUT}^B$ is ten bits; this means that the number of bits of the output image data $D_{OUT}^R$, $D_{OUT}^G$ and $D_{OUT}^B$ is larger than that of the input image data $D_{IN}^R$, $D_{IN}^G$ and $D_{IN}^B$.

The coefficients of the arithmetic expression used for the gamma correction by the approximate gamma correction unit 22R are determined on the basis of the correction point data CP0 to CP5 of the correction point data set $CP_sel^R$. Correspondingly, the coefficients of the arithmetic expressions used for the gamma corrections by the approximate gamma correction units 22G and 22B are determined on the basis of the correction point data CP0 to CP5 of the correction point data set $CP_sel^G$ and $CP_sel^B$, respectively.

The approximate gamma correction units 22R, 22G and 22B have the same function except for that the input image data and the correction point data sets fed thereto are different.

Referring back to FIG. 5, the color reduction circuit 23, the latch circuit 24, the grayscale voltage generator circuit 25 and the data line drive circuit 26 function in total as a drive circuitry which drives the data lines 8 of the display region 5 of the LCD panel 2 in response to the output image data $D_{OUT}$ generated by the approximate gamma correction circuit 22. Specifically, the color reduction circuit 23 performs a color reduction on the output image data $D_{OUT}$ generated by the approximate gamma correction circuit 22 to generate color-reduced image data $D_{OUT_D}$. The latch circuit 24 latches the color-reduced image data $D_{OUT_D}$ from the color reduction circuit 23 in response to a latch signal $S_{STB}$ received from the timing control circuit 27 and forwards the color-reduced image data $D_{OUT_D}$ to the data line drive circuit 26. The grayscale voltage generator circuit 25 feeds a set of grayscale voltages to the data line drive circuit 26. In one embodiment, the number of the grayscale voltages fed from the grayscale voltage generator circuit 25 may be 256 ($=2^8$) in view of the configuration in which the grayscale level of each subpixel 11 of each pixel 9 is represented with eight bits. The data line drive circuit 26 drives the data lines 8 of the display region 5 of the LCD panel 2 in response to the color-reduced image data $D_{OUT_D}$ received from the latch circuit 24. In detail, the data line drive circuit 26 selects desired grayscale voltages from the set of the grayscale voltages received from the grayscale voltage generator circuit 25 in response to color-reduced image data $D_{OUT_D}$, and drives the corresponding data lines 8 of the LCD panel 2 to the selected grayscale voltages.

The timing control circuit 27 performs timing control of the entire drive IC 3 in response to the synchronization data $D_{SYNC}$. In detail, the timing control circuit 27 generates the latch signal $S_{STB}$ in response to the synchronization data $D_{SYNC}$ and feeds the generated latch signal $S_{STB}$ to the latch circuit 24. The latch signal $S_{STB}$ is a control signal instructing the latch circuit 24 to latch the color-reduced data $D_{OUT_D}$. Furthermore, the timing control circuit 27 generates a frame signal $S_{FRM}$ in response to the synchronization data $D_{SYNC}$ and feeds the generated frame signal $S_{FRM}$ to the characterization data calculation circuit 28 and the correction point data calculation circuit 29. It should be noted here that the frame signal $S_{FRM}$ is a control signal which informs the characterization data calculation circuit 28 and the correction point data calculation circuit 29 of the start of each frame period; the frame signal $S_{FRM}$ is asserted at the beginning of each frame period. A vertical synchronization signal $V_{SYNC}$ generated in response to the synchronization data $D_{SYNC}$ may be used as the frame signal $S_{FRM}$. The timing control circuit 27 also generates coordinate data $D_{(X,\ Y)}$ indicating the coordinates of the pixel 9 for which the input image data $D_{IN}$ currently indicate the grayscale levels of the respective subpixels 11 thereof. When input image data $D_{IN}$ which describe the grayscale levels of the respective subpixels 11 of a certain pixel 9 are fed to the characterization data calculation circuit 28, the timing control circuit 27 feeds coordinate data $D_{X,\ Y}$ indicating the coordinates of the certain pixel 9 in the display region 5 to the characterization data calculation circuit 28.

The characterization data calculation circuit 28 and the correction point data calculation circuit 29 constitute a circuitry which generates the correction point data $CP_sel^R$, $CP_sel^G$ and $CP_sel^B$ in response to the input image data $D_{IN}$ and feeds the generated correction point data sets $CP_sel^R$, $CP_sel^G$ and $CP_sel^B$ to the approximate gamma correction circuit 22.

Figure 8:
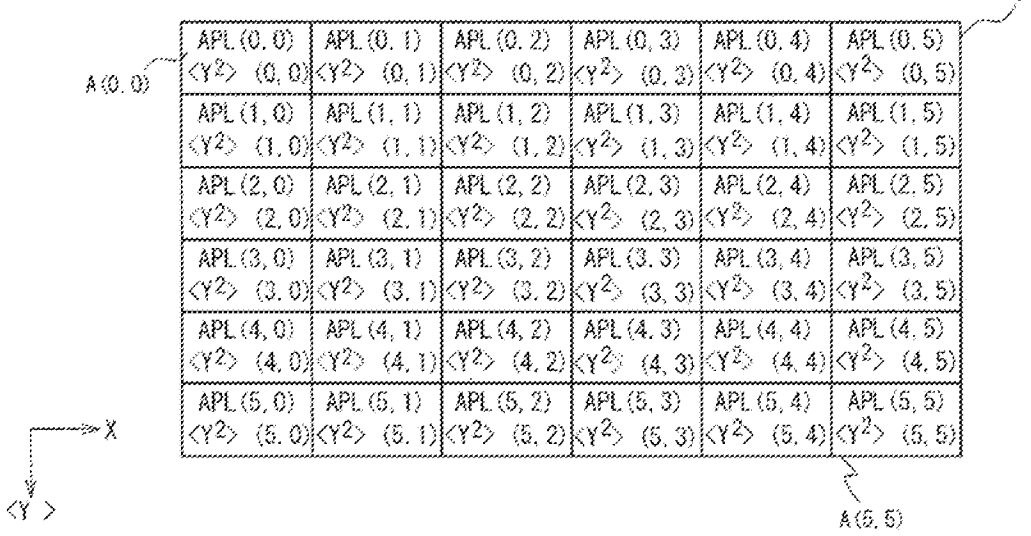
FIG. 8 illustrates the areas defined in the display region of an LCD panel and contents of area characterization data calculated for each area.

In detail, the characterization data calculation circuit 28 includes an area characterization data calculation section 28*a* and a pixel-specific characterization data calculation section 28*b*. The area characterization data calculation section 28*a* calculates area characterization data $D_{CHR_area}$ for each of a plurality of areas defined by dividing the display region 5 of the LCD panel 2. FIG. 8 illustrates the areas defined in the display region 5.

The display region 5 of the LCD panel 2 is divided into a plurality of areas. In the example illustrated in FIG. 8, the display region 5 is divided into 36 rectangular areas arranged in six rows and six columns. In the following, each area of the display region 5 may be denoted by A(N, M), where N is an index indicating the row in which the area is located and M is an index indicating the column in which the area is located. In the example illustrated in FIG. 8, N and M are both an integer from zero to five. When the display region 5 of the LCD panel 2 is configured to include 1920×1080 pixels, the X-axis direction pixel number Xarea, which is the number of pixels 9 arrayed in the X-axis direction in each area, is 320 (=1920/6) and the Y-axis direction pixel number Yarea, which is the number of pixels 9 arrayed in the Y-axis direction in each area, is 180 (=1080/6). Furthermore, the total area pixel number Data_Count, which is the number of pixels included in each area, is 57600 (=1920/6×1080/6).

The area characterization data $D_{CHR_AREA}$ indicate one or more feature quantities of an image obtained by applying a predetermined filtering process to the image associated with input image data $D_{IN}$ in each area. In the present embodiment, an appropriate contrast enhancement is achieved for each area by generating each correction point data set $CP_sel^k$ in response to the area characterization data $D_{CHR_AREA}$ and performing a correction calculation (or gamma correction) in accordance with the gamma curve defined by the correction point data set $CP_sel^k$.

It should be noted that the area characterization data $D_{CHR_AREA}$ are calculated by the area characterization data calculation section 28*a* from image data obtained by applying a filtering process to the input image data $D_{IN}$, not directly from the input image data $D_{IN}$. The contents and the generation method of the area characterization data $D_{CHR_AREA}$ area described later in detail.

Referring back to FIG. 5, the pixel-specific characterization data calculation section 28*b* calculates pixel-specific characterization data $D_{CHR_PIXEL}$ from the area characterization data $D_{CHR_AREA}$ received from the area characterization data calculation section 28*a*. The pixel-specific characterization data $D_{CHR_PIXEL}$ are calculated for each pixel 9 in the display region 5; pixel-specific characterization data $D_{CHR_PIXEL}$ associated with a certain pixel 9 are calculated on the basis of area characterization data $D_{CHR_AREA}$ calculated for the area in which the certain pixel 9 is located and area characterization data $D_{CHR_AREA}$ calculated for the areas adjacent to the area in which the certain pixel 9 is located. This implies that pixel-specific characterization data $D_{CHR_PIXEL}$ associated with a certain pixel 9 indicate feature quantities of the image displayed in a region around the certain pixel 9. The contents and the generation method of the pixel-specific characterization data $D_{CHR_PIXEL}$ are described later in detail.

The correction point data calculation circuit 29 generates the correction point data sets $CP_sel^R$, $CP_sel^G$ and $CP_sel^B$ in response to the pixel-specific characterization data $D_{CHR_PIXEL}$ received from the pixel-specific characterization data calculation section 28*b* and feeds the generated correction point data sets $CP_sel^R$, $CP_sel^G$ and $CP_sel^B$ to the approximate gamma correction circuit 22. The correction point data calculation circuit 29 and the approximate gamma correction circuit 22 constitute a correction circuitry which generates the output image data $D_{OUT}$ by performing a correction on the input image data $D_{IN}$ in response to the pixel-specific characterization data $D_{CHR_PIXEL}$.

Figure 9:
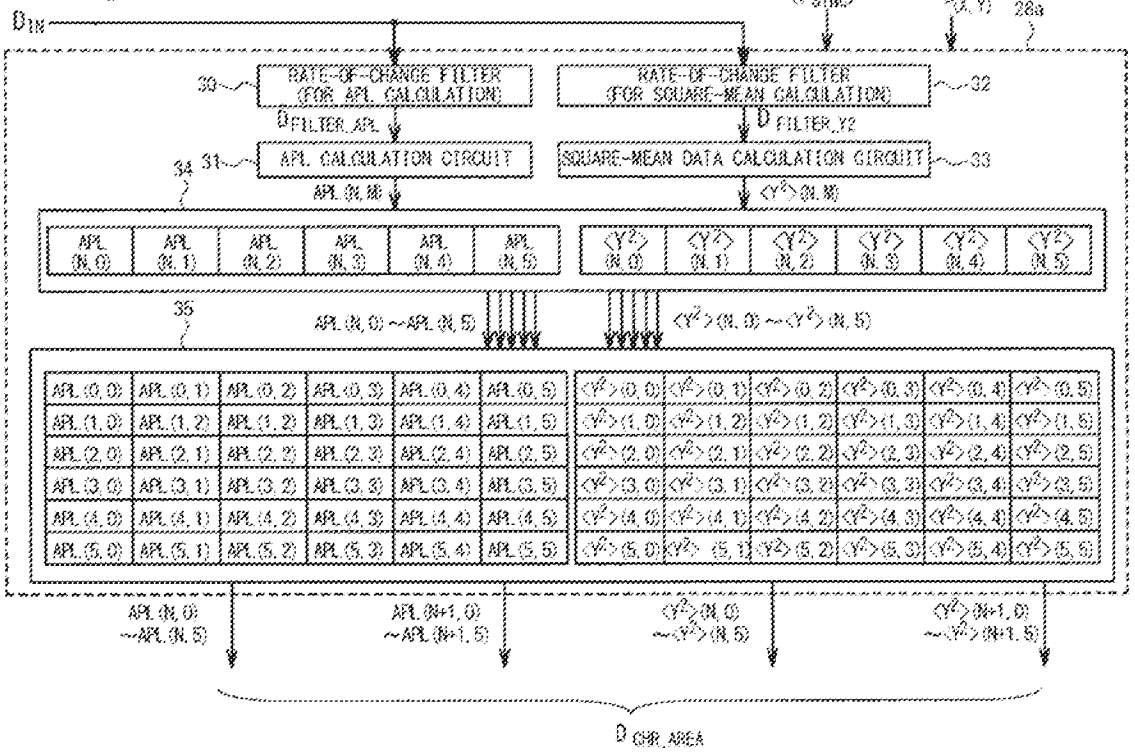
FIG. 9 is a block diagram illustrating a preferred configuration of an area characterization data calculation section in the present embodiment.

FIG. 9 is a block diagram illustrating a preferred configuration of the area characterization data calculation section 28*a*, which calculates the area characterization data $D_{CHR_AREA}$. In one embodiment, the area characterization data calculation section 28*a* includes a rate-of-change filter 30, an APL calculation circuit 31, a rate-of-change filter 32 and a square-mean data calculation circuit 33, a characterization data calculation result memory 34 and an area characterization data memory 35.

The rate-of-change filter 30 calculates the luminance value of each pixel 9 by performing a color transformation (such as an RGB-YUB transformation and an RGB-YCbCr transformation) on the input image data $D_{IN}$ (which describe the grayscale levels of the R subpixel 11R, G subpixel 11G and B subpixel 11B of each pixel 9), and generates APL-calculation image data $D_{FILTER_APL}$ by performing a filtering process. The APL-calculation image data $D_{FILTER_APL}$ are image data used for calculation of the APL of each area and indicate the luminance value of each pixel 9. In this operation, the rate-of-change filter 30 recognizes the association of the input image data $D_{IN}$ fed thereto with the pixels 9 on the basis of the frame signal $S_{FRM}$ and the coordinate data $D_{(X,Y)}$, which are received from the timing control circuit 27.

The APL calculation circuit 31 calculates the APL of each area, which may be referred to as APL(N, M), from the A PL-calculation image data $D_{FILTER_APL}$. In this operation, the APL calculation circuit 31 recognizes the association of the input image data $D_{IN}$ fed thereto with the pixels 9 on the basis of the frame signal $S_{FRM}$ and the coordinate data $D_{(X,Y)}$, which are received from the timing control circuit 27.

The rate-of-change filter 32, on the other hand, calculates the luminance value of each pixel 9 by performing a color transformation on the input image data $D_{IN}$, and generates square-mean-calculation image data $D_{FILTER_Y2}$ by performing a filtering process. The square-mean-calculation image data $D_{FILTER_Y2}$ are image data used for calculation of the mean of squares of the luminance values of the pixels 9 of each area and indicate the luminance value of each pixel 9 similarly to the APL-calculation image data $D_{FILTER_APL}$. In this operation, the rate-of-change filter 32 recognizes the association of the input image data $D_{IN}$ fed thereto with the pixels 9 on the basis of the frame signal $S_{FRM}$ and the coordinate data $D_{(X,Y)}$, which are received from the timing control circuit 27. It should be noted that the rate-of-change filters 30 and 32 may share a circuitry which performs the color transformation on the input image data $D_{IN}$ to calculate the luminance value of each pixel.

The square-mean data calculation circuit 33 calculates square-mean data $\langle Y^2 \rangle$(N, M) which indicate the mean of squares of the luminance values of pixels 9 in each area, from the square-mean calculation image data $D_{FILTER_Y2}$. In this operation, the square-mean data calculation circuit 33 recognizes the association of the input image data $D_{IN}$ fed thereto with the pixels 9 on the basis of the frame signal $S_{FRM}$ and the coordinate data $D_{(X,Y)}$, which are received from the timing control circuit 27.

In the following, in order to distinguish the filtering processes performed by the rate-of-change filters 30 and 32, the filtering process performed by the rate-of-change filter 30 is referred to as APL-calculating filtering process (first filtering process), and the filtering process performed by the rata-of-change filter 32 is referred to as square-mean-calculating filtering process (second filtering process). As is discussed later, the APL-calculating filtering process and the square-mean-calculating filtering process performed by the rate-of-change filters 30 and 32 are of significance for suppressing discontinuities in the display image at the boarders between the areas while also suppressing occurrence of a halo effect.

According to these definitions, the APL calculation circuit 31 calculates the APL of each of the areas in an image obtained by applying the APL-calculating filtering process to a luminance image associated with input image data $D_{IN}$ (the image thus obtained may be referred to as "APL-calculation luminance image", hereinafter). The APL calculated for an area A(N, M) may be denoted by APL(N, M), hereinafter. The APL of each area in an APL-calculation luminance image associated with APL-calculation image data $D_{FILTER_APL}$ is calculated as the average value of the luminance values of pixels in each area.

The square-mean data calculation circuit 33 calculates the mean of squares of the luminance values of pixels 9 in each area of an image obtained by performing a square-mean-calculating filtering process on an luminance image associated with input image data $D_{IN}$ (the image thus obtained may be referred to as "square-mean calculation luminance image", hereinafter). The mean of squares of the luminance values of pixels 9 calculated for the area A(N, M) may be denoted by $Y^2$(N, M), hereinafter.

In the present embodiment, the APL of each area of an APL-calculation luminance image and the mean of squares of the luminance values of pixels 9 in each area of a square-mean calculation luminance image are used as feature quantities indicated by area characterization data $D_{CHR_AREA}$. In other words, area characterization data $D_{CHR_AREA}$ includes APL data indicating the APL of each area of an APL-calculation luminance image and square mean data indicating the mean of squares of the luminance values in each area of a square-mean calculation luminance image.

The characterization data calculation result memory 34 sequentially receives and stores the APL data and square-mean data of the area characterization data $D_{CHR_AREA}$ calculated by the APL calculation circuit 31 and the square-mean data calculation circuit 33, respectively. The characterization data calculation result memory 34 is configured to store area characterization data $D_{CHR_AREA}$ associated with one row of areas A(N, 0) to A(N, 5) (that is, APL(N, 0) to APL (N, 5) and $<Y^2>$(N, 0) to $<Y^2>$(N, 5)). The characterization data calculation result memory 34 also has the function of forwarding the area characterization data $D_{CHR_AREA}$ associated with one row of areas A(N, 0) to A(N, 5), which are stored therein, to the area characterization data memory 35.

The area characterization data memory 35 sequentially receives the area characterization data $D_{CHR_AREA}$ from the characterization data calculation result memory 34 in units of rows of areas and stores therein the received the area characterization data $D_{CHR_AREA}$. The area characterization data memory 35 is configured to store the area characterization data $D_{CHR_AREA}$ of all of the areas A(0,0) to A(5,5) in the display region 5. The area characterization data memory 35 also has she function of outputting area characterization data $D_{CHR_AREA}$ associated with adjacent two rows of areas A(N, 0) to A(N, 5) and A(N+1, 0) to A(N+1, 5), out of the area characterization data $D_{CHR_AREA}$ stored therein.

Figure 10:
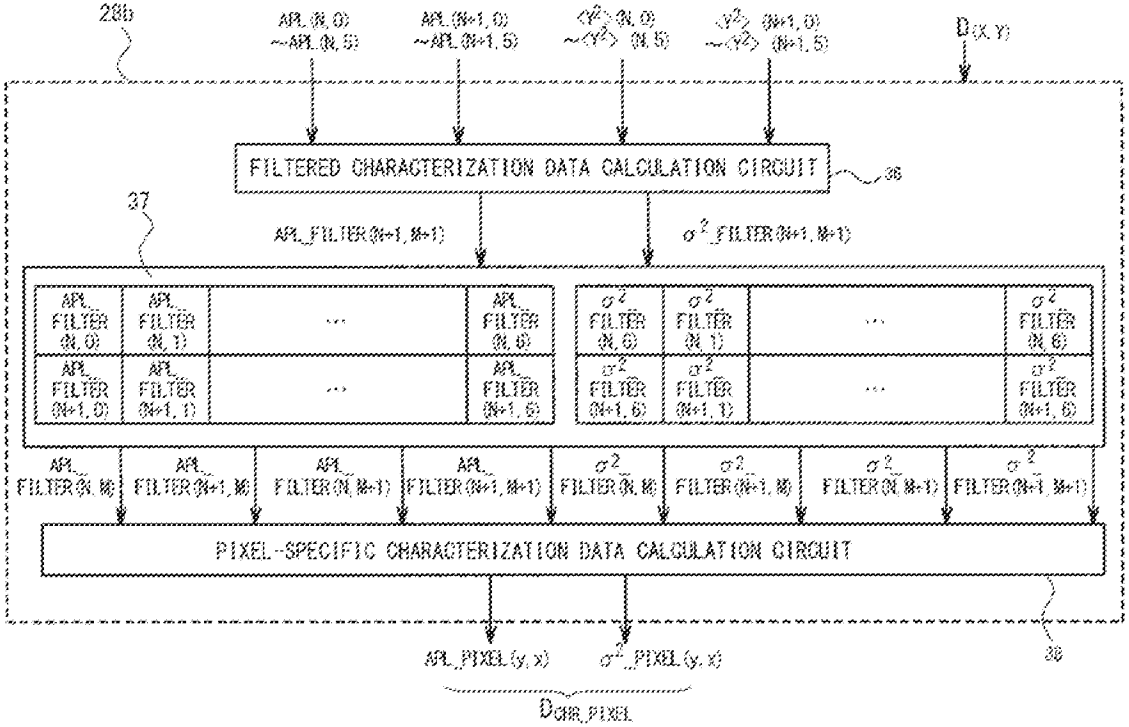
FIG. 10 illustrates one preferred example of the configuration of a pixel-specific characterization data calculation section in the present embodiment.

FIG. 10 illustrates one preferred example of the configuration of the pixel-specific characterization data calculation section 28*b*. The pixel-specific characterization data calculation section 28*b* includes a filtered characterization data calculation circuit 36, a filtered characterization data memory 37 and a pixel-specific characterization data calculation circuit 38. The filtered characterization data calculation circuit 36 performs a sort of filtering process on the area characterization data $D_{CHR_AREA}$ received from the area characterization data memory 35 of the area characterization data calculation section 28*a*.

Figure 11:
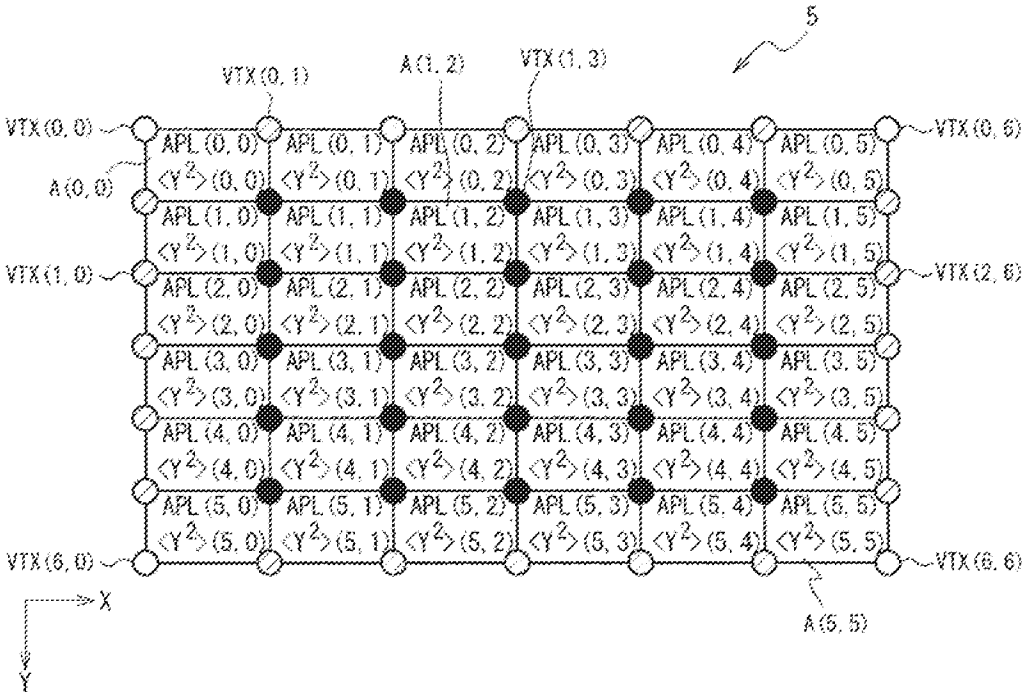
FIG. 11 is a diagram illustrating the contents of filtered characterization data in the present embodiment.

FIG. 11 is a diagram illustrating the contents of the filtered characterization data $D_{CHR_FILTER}$. The filtered characterization data $D_{CHR_FILTER}$ are calculated for each of the vertices of each area. In the present embodiment, each area is rectangular and has four vertices. Since adjacent areas share vertices, the vertices of the areas are arrayed in rows and columns in the display region 5. When the display region 5 includes areas arrayed in six rows and six columns, for example, the vertices are arrayed in seven rows and seven columns. Each vertex of the areas defined in the display region 5 may be denoted by VTX(N, M), hereinafter, where N is an index indicating the row in which the vertex is located and M is an index indicating the column in which the vertex is located.

Filtered characterization data $D_{CHR_FILTER}$ associated with a certain vertex are calculated from the area characterization data $D_{CHR_AREA}$ associated with the area (s) which the vertex belongs to. It should be noted that a vertex may belong to a plurality of areas, and filtered characterization data $D_{CHR_FILTER}$ associated with such a vertex are calculated by applying a sort of filtering process (most simply, a process of calculating the average values) to area characterization data $D_{CHR_AREA}$ with associated with the plurality of areas.

In the present embodiment, the area characterization data $D_{CHR_{AREA}}$ include APL data and square-mean data calculated for each area while the filtered characterization data $D_{CHR_FILTER}$ include APL data and variance data calculated for each vertex. APL data of filtered characterization data $D_{CHR_FILTER}$ associated with a certain vertex are calculated from APL data of area characterization data $D_{CHR_AREA}$ associated with an area(s) which the certain vertex belongs to. Variance data of filtered characterization data $D_{CHR_FILTER}$ associated with a certain, vertex are calculated from APL data and square-mean data of area characterization data $D_{CHR_AREA}$ associated with an area(a) which the certain vertex belongs to. APL data of filtered characterization data $D_{CHR_FILTER}$ are data corresponding to the APL of a region around the associated vertex and variance data of filtered characterization data $D_{CHR_FILTER}$ are data corresponding to the variance of the luminance values of the pixels in the region around the associated vertex. In FIG. 10, APL data of filtered characterization data $D_{CHR_FILTER}$ associated with a vertex VTX(N, M) are denoted by the numeral "APL_FILTER(N, M)" and variance data of filtered characterization data $D_{CHR_FILTER}$ associated with the vertex VTX(N, M) are denoted by the numeral "$\sigma^2$_FILTER(N, M)". Details of the calculation of the filtered characterization data $D_{CHR_FILTER}$ are described later.

The filtered characterization data memory 37 stores therein the filtered characterization data $D_{CHR_FILTER}$ thus calculated. The filtered characterization data memory 37 has a memory capacity sufficient to store filtered characterization data $D_{CHR_FILTER}$ for two rows of vertices.

The pixel-specific characterization data calculation circuit 38 calculates pixel-specific characterization data $D_{CHR_PIXEL}$ from the filtered characterization data $D_{CHR_FILTER}$ received from the filtered characterization data memory 37. The pixel-specific characterization data $D_{CHR_PIXEL}$ indicate one or more feature quantities calculated for each of the pixels 9 in the display region 5. In the present embodiment, the filtered characterization data $D_{CHR_FILTER}$ include APL data and variance data and accordingly the pixel-specific characterization data $D_{CHR_PIXEL}$ include APL data and variance data. The APL data of the pixel-specific characterization data $D_{CHR_PIXEL}$ generally indicate the APL of the region around the associated pixel 9 and the variance data of the pixel-specific characterization data $D_{CHR_PIXEL}$ generally indicate the variance of the luminance values of the pixels 9 in the region around the associated pixel 9.

Pixel-specific characterization data $D_{CHR_PIXEL}$ associated with a certain pixel 9 are calculated by applying a linear interpolation to the filtered characterization data $D_{CHR_FILTER}$ associated with the vertices of the area in which the certain pixel 9 is located, on the basis of the position of the certain pixel 9. In detail, APL data of pixel-specific characterization data $D_{CHR_PIXEL}$ associated with a certain pixel 9 are calculated by applying a linear interpolation to APL data of the filtered characterization data $D_{CHR_FILTER}$ associated with the vertices of the area in which the certain pixel 9 is located, on the basis of the position of the certain pixel 9. Correspondingly, variance data of pixel-specific characterization data $D_{CHR_PIXEL}$ associated with a certain pixel 9 are calculated by applying a linear interpolation to variance data of the filtered characterization data $D_{CHR_FILTER}$ associated with the vertices of the area in which the certain pixel 9 is located, on the basis of the position of the certain pixel 9. In FIG. 10, APL data of pixel-specific characterization data $D_{CHR_PIXEL}$ associated with a pixel 9 positioned at position (x, y) in the display region 5 are denoted by the symbol "APL_PIXEL(y, x)" and variance data of pixel-specific characterization data $D_{CHR_PIXEL}$ associated with a pixel 9 positioned at position (x, y) in the display region 5 are denoted by the symbol "$\sigma^2$_PIXEL(y, x)". Details of the calculation of the pixel-specific characterization data $D_{CHR_PIXEL}$ described later. The pixel-specific characterization data $D_{CHR_PIXEL}$ calculated by the pixel-specific characterization data calculation circuit 38 are forwarded to the correction point data calculation circuit 29.

Figure 12:
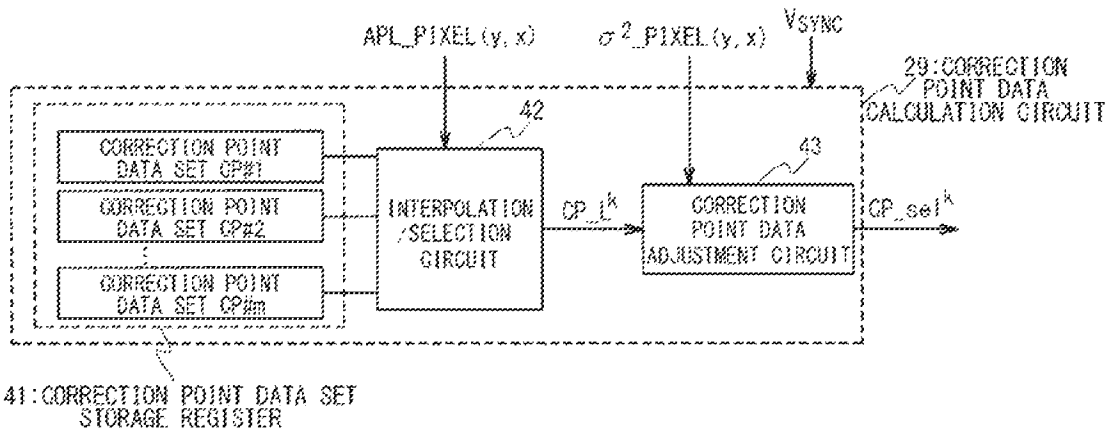
FIG. 12 is a block diagram illustrating a preferred example of the configuration of a correction point data calculation circuit in the present embodiment.

FIG. 12 is a block diagram illustrating a preferred example of the configuration of the correction point data calculation circuit 29. In the example illustrated in FIG. 12, the correction point data calculation circuit 29 includes: a correction point data set storage register 41, an interpolation/selection circuit 42 and a correction point data adjustment circuit 43.

The correction point data set storage register 41 stores therein a plurality of correction point data sets CP#1 to CP#m. The correction point data sets CP#1 to CP#m are used as seed data for determining the above-described correction point data sets $CP_L^R$, $CP_L^G$ and $CP_L^B$. Each of the correction point data sets CP#1 to CP#m includes correction point data CP0 to CP5 defined as illustrated in FIG. 6.

The interpolation/selection circuit 42 determines gamma values $\gamma_{PIXEL}^R$, $\gamma_{PIXEL}^G$ and $\gamma_{PIXEL}^B$ on the basis of the APL data APL_PIXEL(y, x) of the pixel-specific characterization data $D_{CHR_PIXEL}$ and determines the correction point data sets $CP_L^R$, $CP_L^G$ and $CP_L^B$ corresponding to the gamma values $\gamma_{PIXEL}^R$, $\gamma_{PIXEL}^G$ and $\gamma_{PIXEL}^B$ thus determined. Here, the gamma value $\gamma_{PIXEL}^R$ is the gamma value of a gamma curve used for contrast correction to be performed on data indicating the grayscale level of an R subpixel 11R of input image data $D_{IN}$ (that is, input image data $D_{IN}^R$). Correspondingly, the gamma value $\gamma_{PIXEL}^G$ is the gamma value of a gamma curve used for contrast correction to be performed on data indicating the grayscale level of a G subpixel 11G of input image data $D_{IN}$ (that is, input image data $D_{IN}^G$) and the gamma value $\gamma_{PIXEL}^B$ is the gamma value of a gamma curve used for contrast correction to be performed on data indicating the grayscale level of a B subpixel 11B of input image data $D_{IN}$ (that is, input image data $D_{IN}^B$).

In one embodiment, the interpolation/selection circuit 42 may select one of the correction point data sets CP#1 to CP#m on the basis of the gamma value $\gamma_{PIXEL}^k$ and determine the correction point data set $CP_L^k$ as the selected one of the correction point data sets CP#1 to CP#m. Alternatively, the interpolation/selection circuit 42 may determine the correction point data set $CP_L^k$ by selecting two of correction point data sets CP#1 to CP#m on the basis of the gamma value $\gamma_{PIXEL}^k$ and applying a linear interpolation to the selected two correction point data sets. Details of the determination of the correction point data sets $CP_L^R$, $CP_L^G$ and $CP_L^B$ are described later. The correction point data sets $CP_L^R$, $CP_L^G$and $CP_L^B$ determined by the interpolation/selection circuit 42 are forwarded to the correction point data adjustment circuit 43.

The correction point data adjustment circuit 43 modifies the correction point data sets $CP_L^B$, $CP_L^G$ and $CP_L^B$on the basis of the variance data $\sigma^2$_PIXEL(y, x) included in the pixel-specific characterization data $D_{CHR_PIXEL}$, to thereby calculate the correction point data sets $CP_sel^R$, $CP_sel^G$ and $CP_sel^B$, which are finally fed to the approximate gamma correction circuit 22. Details of the operations of the respective circuits in the correction point data calculation circuit 29 are described later.

Figure 13:
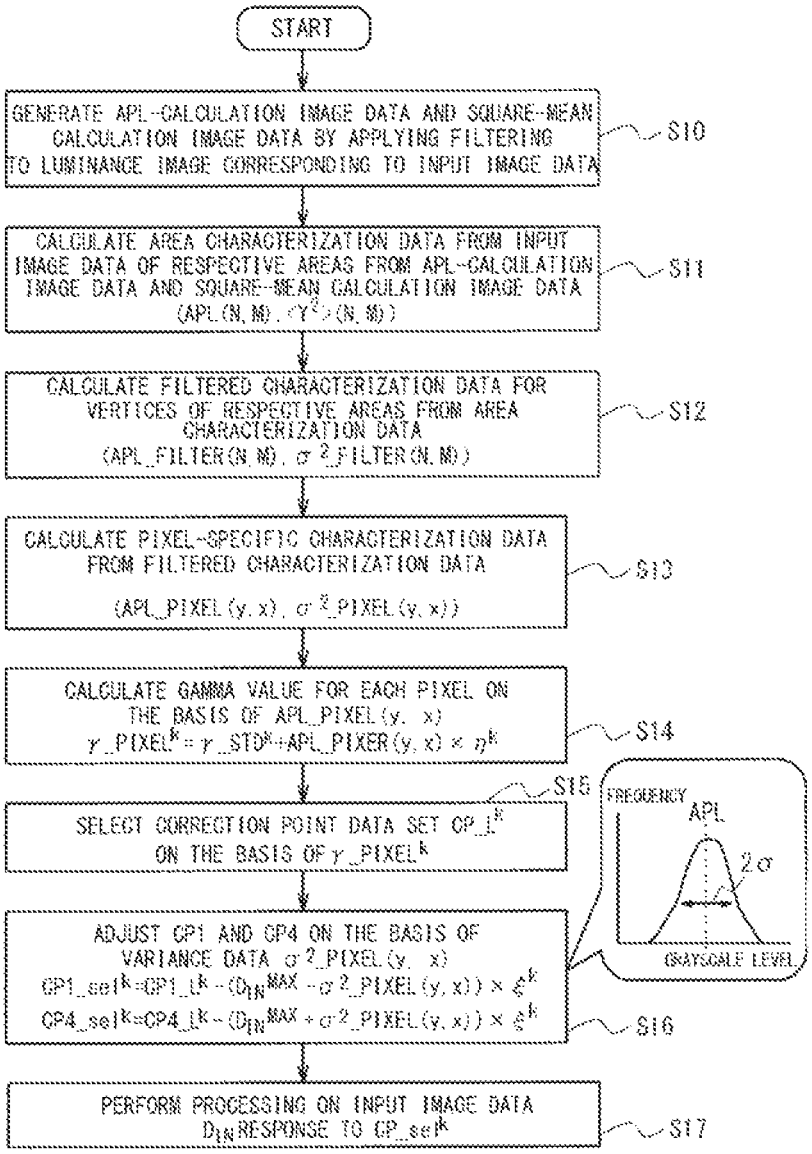
FIG. 13 is a flowchart illustrating the procedure of a correction calculation performed on input image data in the present embodiment.

Next, an overview of the operation of the liquid crystal display device 1 in the present embodiment, particularly the correction calculation for contrast correction, is given below. FIG. 13 is a flowchart illustrating the contents of the correction calculation for the contrast correction performed in the liquid crystal display device 1 in the present embodiment.

Overall, the correction calculation in the present embodiment includes a first phase in which the shape of the gamma curve used for the contrast correction is determined for each subpixel 11 of each pixel 9 (steps S10 to S16) and a second phase in which a correction calculation is performed on input image data $D_{IN}$ associated with each subpixel 11 of each pixel 9 in accordance with the determined gamma curve (step S17). As the shape of a gamma curve used for contrast correction is specified by a correction point data set $CP_sel^k$ in the present embodiment, the first phase involves determining a correction point data set $CP_sel^k$ is determined for each subpixel 11 of each pixel 9 and the second phase involves performing correction calculation on input image data $D_{IN}$ associated with each subpixel 11 in accordance with the determined correction point data sat $CP_sel^k$.

Overall, the determination of the shape of the gamma curve in the first phase is achieved as follows: Note that details of the calculation at each step in the first phase are described later.

At step S10, APL-calculation image data $D_{FILTER_APL}$ are generated by applying the APL-calculating filtering process to the input image data $D_{IN}$ and square-mean calculation image data $D_{FILTER_Y2}$ are generated by applying the square-mean-calculating filtering process to the input image data $D_{IN}$. Note that the APL-calculation image data $D_{FILTER_APL}$ indicate the luminance values of the respective pixels 9 of the APL-calculation luminance image and the square-mean-calculation image data $D_{FILTER_Y2}$ indicate the luminance values of the respective pixels 9 of the square-mean-calculation luminance image. As described above, the APL-calculation filtering process is performed by the rate-of-change filter 30 in the area characterization data calculation section 28*a* of the characterization data calculation circuit 28 and the square-mean-calculating filtering process is performed by the rate-of-change filter 32 (see FIG. 9). Details of the contents of the APL-calculating filtering process and square-mean-calculating filtering process and technical meanings thereof are described later.

At step S11, area characterization data $D_{CHR_AREA}$ of each area of the display region 5 of the LCD panel 2 are calculated from the APL-calculation image data $D_{FILTER_APL}$ and the square-mean-calculation image data $D_{FILTER_Y2}$. As described above, area characterization data $D_{CHR_AREA}$ associated with each area include APL data and square-mean data (see FIG. 8). The APL data of the area characterization data $D_{CHR_AREA}$ are calculated from the APL-calculation image data $D_{FILTER_APL}$ square-mean data of the area characterization data $D_{CHR_AREA}$ are calculated from the square-mean-calculation image data $D_{FILTER_Y2}$. The calculation of the APL data of the area characterization data $D_{CHR_AREA}$ is achieved by the APL calculation circuit 31 of the area characterization data calculation section 28*a* of the characterization data calculation circuit 28, and the calculation of the square-mean data of the area characterization data $D_{CHR_AREA}$ is achieved by the square-mean data calculation circuit 33.

At step S12, filtered characterization data $D_{CHR_FILTER}$ associated with the vertices of each area are then calculated from the area characterization data $D_{CHR_AREA}$ associated with each area by the filtered characterization data calculation circuit 36 of the pixel specific characterization data calculation section 28*b* of the characterization data calculation circuit 28. Referring to FIG. 11, filtered characterization data $D_{CHR_FILTER}$ associated with a certain vertex are calculated from area characterization data $D_{CHR_AREA}$ associated with an area (or areas) which the certain vertex belongs to. Note that the certain vertex may belong to a plurality of areas. As described above, filtered characterization data $D_{CHR_FILTER}$ include APL data and variance data. In detail, APL data of filtered characterization data $D_{CHR_FILTER}$ associated with a certain vertex are calculated from APL data of area characterization data $D_{CHR_AREA}$ associated with the area (or areas) which the certain vertex belongs to, and variance data of filtered characterization data $D_{CHR_FILTER}$ associated with a certain vertex are calculated from APL data and square-mean data of area characterization data $D_{CHR_AREA}$ associated with an area (or areas) which the certain vertex belongs to.

Furthermore, at step S13, pixel-specific characterization data $D_{CHR_PIXEL}$ associated with each pixel 9 are calculated by the pixel-specific characterization data calculation circuit 38 of the pixel-specific characterization data calculation section 28*b* from filtered characterization data $D_{CHR_FILTER}$ associated with the vertices of each area. Pixel-specific characterization data $D_{CHR_PIXEL}$ associated with a certain pixel 9 located in a certain area are calculated by applying a linear interpolation to filtered characterization data $D_{CHR_FILTER}$ associated with the vertices of the certain area on the basis of the position of the certain pixel 9 in the certain area. As described above, pixel-specific characterization $D_{CHR_PIXEL}$ include APL data and variance data. APL data of pixel-specific characterization data $D_{CHR_PIXEL}$ associated with a certain pixel 9 are calculated from APL data of filtered characterization data $D_{CHR_FILTER}$ associated with the vertices of the area in which the certain pixel 9 is located and variance data of pixel-specific characterization data $D_{CHR_PIXEL}$ associated with a certain pixel 9 are calculated from variance data of filtered characterization data $D_{CHR_FILTER}$ associated with the vertices of the area in which the certain pixel 9 is located.

At step S14, the gamma values $\gamma_{PIXEL}^{R}$, $\gamma_{PIXEL}^{G}$ and $\gamma_{PIXEL}^{B}$ of gamma curves used for correction calculation of each pixel 9 are calculated from APL data APL_PIXEL(y, z) of pixel-specific characterization data $D_{CHR_PIXEL}$ associated with each pixel 9. Furthermore, correction point data sets $CP_L^{R}$, $CP_L^{G}$ and $CP_L^{B}$, which indicate the gamma curves specified by the gamma values $\gamma_{PIXEL}^{R}$, $\gamma_{PIXEL}^{G}$ and $\gamma_{PIXEL}^{B}$, respectively, are selected or determined at step S15. The calculation of the gamma values $\gamma_{PIXEL}^{R}$, $\gamma_{PIXEL}^{G}$ AND $\gamma_{PIXEL}^{B}$ and the selection of the correction point data sets $CP_L^{R}$, $CP_L^{G}$ and $CP_L^{B}$ are achieved by the interpolation/selection circuit 42 of the correction point data calculation circuit 29.

At step S16, the correction point data sets $CP_L^{R}$, $CP_L^{G}$ and $CP_L^{B}$ selected for each pixel 9 are modified in response to variance data $\sigma^2$_PIXEL(y, x) of pixel-specific characterization data $D_{CHR_PIXEL}$ associated with each pixel 9 to calculate correction point data sets $CP_sel^{R}$, $CP_sel^{G}$ and $CP_sel^{B}$, which are finally fed to the approximate gamma correction circuit 22. The process of modifying the correction point data sets $CP_L^{k}$ (k is any of "R", "G" and "B") on the basis of variance data $\sigma^2$_PIXEL(y, x) of pixel-specific characterization data $D_{CHR_PIXEL}$ is technically equivalent to a modification of the shape of the gamma curve used for contrast correction of input image data $D_{IN}^{k}$ on the basis of variance data $\sigma^2$_PIXEL(y, x) of pixel-specific characterization data $D_{CHR_PIXEL}$.

The correction point data sets $CP_sel^{R}$, $CP_sel^{G}$ and $CP_sel^{B}$ are forwarded to the approximate gamma correction circuit 22. At step S17, the approximate gamma correction circuit 22 performs a correction calculation on input image data $D_{IN}$ associated with each pixel 9 in accordance with the gamma curves specified by the correction point data sets $CP_sel^{R}$, $CP_sel^{G}$ and $CP_sel^{B}$ determined for each pixel 9.

At the above-described processes at steps S11 to S16, a correction calculation for input image data $D_{IN}$ associated with each pixel 9 located in a certain area is basically achieved by determining pixel-specific characterization data $D_{CHR_PIXEL}$ (APL data and variance data) associated with each pixel on the basis of area characterization data $D_{CHR_AREA}$ (APL data and variance data) associated with the certain area and with the areas adjacent to the certain area, and determining the correction calculation to be performed on the input image data $D_{IN}$ associated with each pixel 9 on the basis of the pixel-specific characterization data $D_{CHR_PIXEL}$ thus determined. The dependency of the pixel-specific characterization data $D_{CHR_PIXEL}$ associated with each pixel 9 on the area characterization data $D_{CHR_AREA}$ associated with the adjacent areas depends on the position of each pixel 9. As a result, the correction calculation determined from the pixel-specific characterization data $D_{CHR_PIXEL}$ may vary depending on the position of each pixel 9 in the area.

Figure 2A:
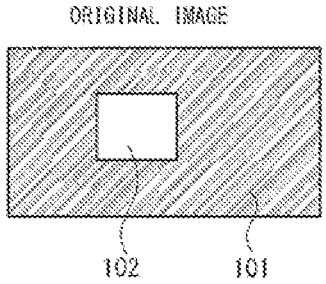
FIGS. 2A to 2C schematically illustrate an example of generation of a halo effect.
Figure 2B:
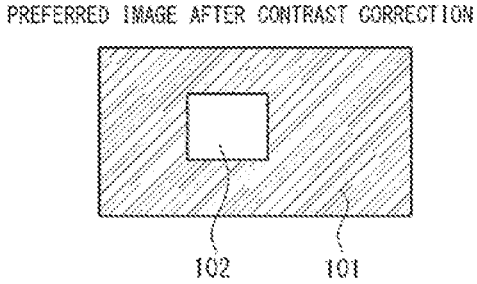
Figure 2C:
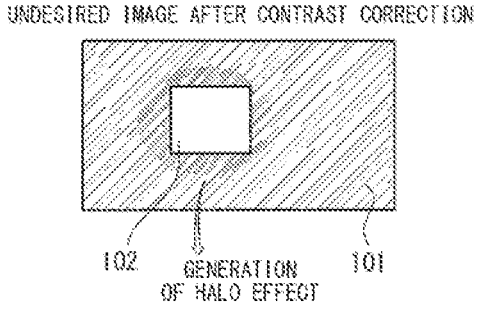

In such a case, as discussed in the above with reference to FIGS. 1 and 2, the correction calculations performed on the input image data $D_{IN}$ may vary depending on the positions of the pixels 9 in the area, even when pixels 9 in a certain region are indicated to display the same color. Although effectively suppressing block noise, such process may cause occurrence of a halo effect.

Figure 14:
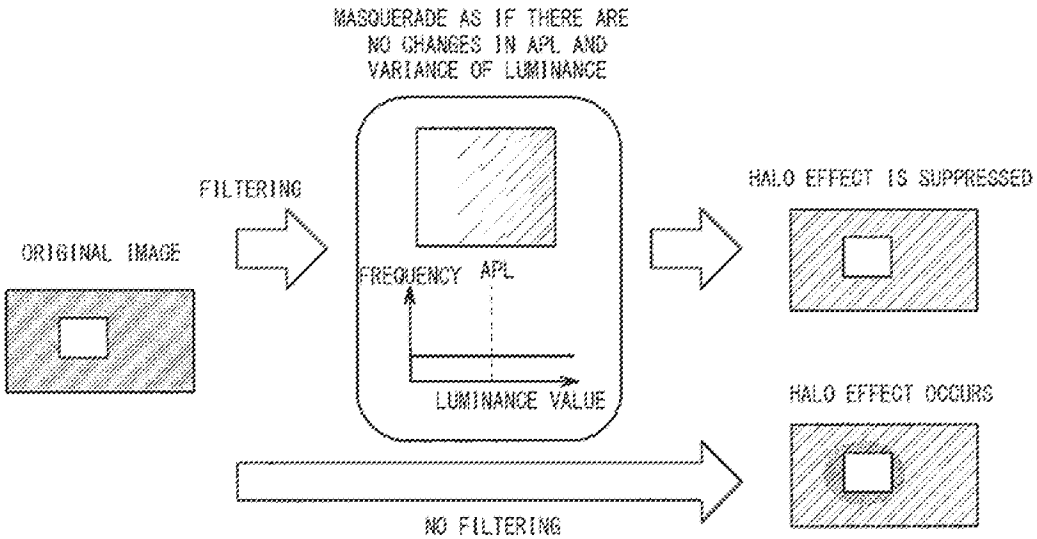
FIG. 14 illustrates the concept of an APL-calculating filtering process and square-mean-calculating filtering process.

The APL-calculating filtering process and square-mean-calculating filtering process performed at step S10 are directed to address the problem of the halo effect. FIG. 14 illustrates the concept of the APL-calculating filtering process and square-mean-calculating filtering process.

The APL-calculating filtering process in the present embodiment includes a calculation to set the luminance value of a pixel 9 of interest (which may be referred to as "target pixel", hereinafter) to a specific luminance value (hereinafter, referred to as "APL-calculation alternative luminance value") in response to the differences of the luminance value of the target pixel from those of the pixels 9 near the target pixel in the original image (that is, the luminance image associated with the input image data $D_{IN}$). When the differences of the luminance value of the target pixel from those of the pixels 9 near the target pixel in the original image are small, the luminance value of the target pixel of the APL-calculation luminance image (luminance image obtained by the APL-calculating filtering processes) is set to the APL-calculation alternative luminance value. Note that the APL-calculation alternative luminance value is a fixed value. When the differences of the luminance value of the target pixel from those of the pixels 9 near the target pixel in the original image are large, on the other hand, the luminance value of the target pixel of the APL-calculation luminance image is set to be equal to the luminance value of the target pixel of the original image. When the differences of the luminance value of the target pixel from those of the pixels 9 near the target pixel in the original image are medium, the luminance value of the target pixel of the APL-calculation luminance image is determined as a weighted average of the luminance value of the target pixel of the original image and the APL-calculation alternative luminance value.

According to such calculation, the APL of an area mainly consisting of a region in which the changes in the luminance value are small is calculated as the APL-calculation alternative luminance value or a value close to the APL-calculation alternative luminance value. As a result, when two areas each of which mainly consists of a region in which the changes in the luminance value are small are adjacent, the APLs of the adjacent two areas are calculated as close values and therefore the gamma values of the gamma curves are calculated as almost the same value with respect to the adjacent two areas at step S14. This results in that gamma curves with similar shapes are determined for the pixels 9 in the adjacent two areas, effectively suppressing occurrence of a halo effect. It should be noted here that, although the luminance values of pixels 9 remain unchanged in the APL-calculating filtering process for a region in which the changes in the luminance value are large, the halo effect is not remarkable in such a case. Furthermore, discontinuities in an image finally displayed in the display region 5 are reduced, because an intermediate calculation of the calculations performed for a region in which the changes in the luminance value are large and for a region in which the changes in the luminance value are small is performed for a region in which the changes in the luminance value are medium.

The APL-calculation alternative luminance value is preferably determined as the average value of the allowed maximum value and allowed minimum value of the luminance value of the luminance image associated with the input image data $D_{IN}$ (that is, the luminance image obtained by performing a color transformation on the input image data $D_{IN}$). Note that the allowed maximum value and allowed minimum value of the luminance value of the luminance image associated with the input image data $D_{IN}$ are determined on the number of bits of data representing the luminance value of each pixel of the luminance image. When the number of bits of data representing the luminance value of each pixel of the luminance image of the input image data $D_{IN}$ is eight, the allowed minimum value is 0 and the allowed maximum value is 255; in this case, the APL-calculation alternative luminance value is preferably determined as 128. It should be noted however that the APL-calculation alternative luminance value may be determined as any value ranging from the allowed minimum value to the allowed maximum value.

Similarly, the square-mean-calculating filtering process in the present embodiment includes a calculation to set the luminance value of the target pixel to a specific luminance value (hereinafter, referred to as "square-mean-calculation alternative luminance value") in response to the differences of the luminance value of the target pixel from those of the pixels 9 near the target pixel in the original image (that is, the luminance image associated with the input image data $D_{IN}$). Note that the square-mean-calculation alternative luminance value is a fixed value. When the differences of the luminance value of the target pixel from those of the pixels 9 near the target pixel in the original image are small, the luminance value of the target pixel of the square-mean calculation luminance image is set to the square-mean calculation alternative luminance value. When the differences of the luminance value of the target pixel from those of the pixels 9 near the target pixel in the original image are large, on the other hand, the luminance value of the target pixel of the square-mean calculation luminance image is set to be equal to the luminance value of the target pixel of the original image. When the differences of the luminance value of the target pixel from those of the pixels 9 near the target pixel in the original image are medium, the luminance value of the target pixel of the square-mean calculation luminance image is determined as a weighted average of the luminance value of the target pixel of the original image and the square-mean-calculation alternative luminance value.

According to such calculation, the mean of squares of the luminance values indicated by the square-mean data associated with an area mainly consisting of a region in which the changes in the luminance value are small is calculated as the square-mean-calculation alternative luminance value or a value close to the square-mean-calculation alternative luminance value. As a result, when two areas each of which mainly consists of a region in which the changes in the luminance value are small are adjacent to each other, the square means of the luminance values are calculated as close values for the adjacent two areas and therefore the shapes of the gamma curves are modified to almost the same degree with respect to the adjacent two areas at step S16. This results in that gamma curves with similar shapes are determined for the pixels 9 in the adjacent two areas, effectively suppressing occurrence of a halo effect. It should be noted here that, although the luminance values of pixels 9 remain unchanged in the square-mean-calculating filtering process for a region in which the changes in the luminance value are large, the halo effect is not remarkable in such a case. Furthermore, discontinuities in an image finally displayed in the display region 5 are reduced, because an intermediate calculation of the calculations performed for a region in which the changes in the luminance value are large and performed for a region in which the changes in the luminance value are small is performed for a region in which the changes in the luminance value are medium.

Figure 15:
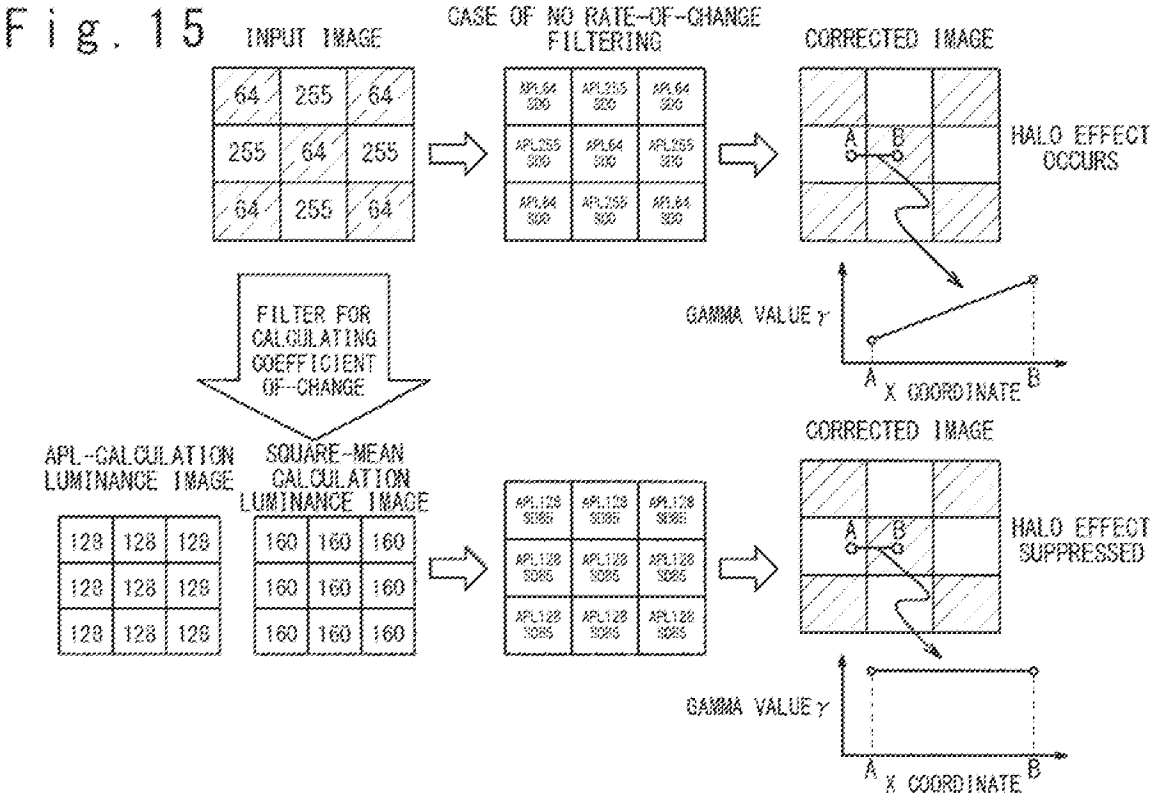
FIG. 15 is a schematic illustration illustrating an example of suppression of a halo effect through the APL-calculating filtering process and the square-mean calculating filtering process.

FIG. 15 is a schematic illustration illustrating an example of suppression of a halo effect through the APL-calculating filtering process and the square-mean calculating filtering process. With reference to the example illustrated in FIG. 15, let us assume for simplicity that areas arrayed in three rows and three columns are defined and areas in which the luminance values of all the pixels are 64 and areas in which the luminance values of all the pixels are 255 are arranged alternately in both of the horizontal and vertical directions. Let us additionally assume that the APL-calculation alternative luminance value is 128 and the square-mean-calculation luminance value is 160.

When the APL-calculating filtering process and the square-mean calculating filtering process are not performed, as illustrated in the upper row of FIG. 15, areas with an APL of 64 and areas with an APL of 255 are arranged alternately in both of the horizontal and vertical directions. Note that the variance of the luminance values of all the areas are calculated as zero and the variance data of the pixel-specific characterization data $D_{CHR_PIXEL}$ are calculated as zero for all the pixels. In this case, different values are obtained as the gamma values of the gamma curves used for correction calculations with respect to pixels A and B positioned in adjacent areas and intermediate values are obtained as the gamma values for pixels positioned between pixels A and B. As a result, correction calculations are performed with different gamma curves for pixels positioned between pixels A and B and this undesirably causes a halo effect.

When the APL-calculating filtering process and the square-mean calculating filtering process are performed, on the other hand, as illustrated in the lower row of FIG. 15, the APL-calculation luminance image are obtained as a luminance image in which all the pixels in all the areas have a luminance value equal to the APL-calculation alternative luminance value (that is, 128) and the square-mean-calculation luminance image are obtained as a luminance image in which all the pixels in all the areas have a luminance value equal to the square-mean-calculation alternative luminance value (that is, 160). The procedure in which the APL data and square-mean data of the area characterization data $D_{CHR_AREA}$ are calculated on the basis of the thus-obtained APL-calculation luminance image and square-mean calculation luminance image and further the APL data and variance data of the pixel-specific characterization data $D_{CHR_PIXEL}$ are calculated on the basis of the area characterization data $D_{CHR_AREA}$ is equivalent to a calculation in which the APL data and variance data of the pixel-specific characterization data $D_{CHR_PIXEL}$ are calculated under an assumption that images in which the luminance values of the pixels are uniformly distributed from the allowed minimum value (for example, 0) to the allowed maximum value (for example 255), that is, images in which the APL is 128 and the standard deviation of the luminance value (that is, the square root of the variance) is 85 are displayed in all the areas. As a result, the gamma values of the gamma curves used for the correction calculations for the pixels A and B, which are positioned adjacent areas, are calculated as the same value. Also, the gemma curves are modified to the same degree with respect to pixels A and B. Accordingly, the correction calculations are performed with the same gamma curve with respect to pixels A and B and pixels between pixels A and B and this affectively avoids occurrence of a halo effect.

In the following, a detailed description is given of the calculations performed at the respective steps illustrated in FIG. 13.

(Step S10)

As described above, at, step S10, the APL-calculating filtering process and the square-mean-calculating filtering processes are performed on input image data $D_{IN}$ to calculate APL-calculation image data (image data of an APL-calculation luminance image) and square-mean-calculation image data (image data of an square-mean-calculation image).

In the APL-calculating filtering process in the present embodiment, the luminance value $Y_j^{APL}$ of pixel #j (that is, the target pixel) in the APL-calculation luminance image is calculated in accordance with the following expression (1):

$$Y_j^{APL}=(1-\alpha)\cdot Y^{APL_SUB}+\alpha\cdot Y_j, \tag{1}$$

where $Y_j$ is the luminance value of pixel #j in the luminance image corresponding to the input image data $D_{IN}$, $Y^{APL_SUB}$ the APL-calculation alternative luminance value, and $\alpha$ is a coefficient of change which ranges from zero to one and indicates the degree of differences of the luminance value of pixel #j from those of pixels near pixel #j in the luminance image corresponding to the input image data $D_{IN}$. The coefficient of change $\alpha$ in expression (1) is set to zero when the differences of the luminance value of pixel #j from those of pixels near pixel #j is small, to one when the differences of the luminance value of pixel #j from those of pixels near pixel #j is large, and to a value between zero to one when the differences of the luminance value of pixel #j from those of pixels near pixel #j is medium.

The above-described expression (1) means that the luminance value $Y_j^{APL}$ of pixel #j in the APL-calculation luminance image is calculated as a weighted average of the APL-calculation alternative luminance value and the luminance value of pixel #j in the luminance image corresponding to the input image data $D_{IN}$, and the weights given to the APL-calculation alternative luminance value and the luminance value of pixel #j in the luminance image corresponding to the input image data $D_{IN}$ depend on the coefficient of change $\alpha$ in the calculation of the weighted average. The luminance value $Y_j^{APL}$ of pixel #j in the APL-calculation luminance image is equal to the APL-calculation alternative luminance value $Y^{APL_SUB}$ when the coefficient of change $\alpha$ is zero, and equal to the luminance value $Y_j$ of pixel #j in the luminance image corresponding to the input image data $D_{IN}$ when the coefficient of change $\alpha$ is one. The luminance value $Y_j^{APL}$ of pixel #j in the APL-calculation luminance image is determined as a value between the APL-calculation alternative luminance value $Y^{APL_SUB}$ and the luminance value $Y_j$ of pixel #j in the luminance image corresponding to the input image data $D_{IN}$ when the coefficient of change $\alpha$ is a value between zero and one.

Correspondingly, the luminance value $Y_j^{<Y2>}$ of pixel #j (that is, the target pixel) in the square-mean-calculation luminance image is calculated in accordance with the following expression (2):

$$Y_j^{<Y2>}=(1-\alpha)\cdot Y^{<Y2>SUB}+\alpha\cdot Y_j, \tag{2}$$

where $Y^{<Y2>_SUB}$ is the square-mean-calculation alternative luminance value and $\alpha$ is the above-described coefficient of change. It should be noted that the coefficient of change $\alpha$ is commonly used for the calculation of the luminance value $Y_j^{APL}$ of pixel #j in the APL-calculation luminance image and the calculation of the luminance value $Y_j^{<Y2>}$ of pixel #j in the square-mean-calculation luminance image.

The above-described expression (2) means that the luminance value $Y_j^{<Y2>}$ of pixel #j in the square-mean-calculation luminance image is calculated as a weighted average of the square-mean-calculation alternative luminance value and the luminance value of pixel #j in the luminance image corresponding to the input image data $D_{IN}$, and the weights given to the square-mean-calculation alternative luminance value and the luminance value of pixel #1 in the luminance image corresponding to the input image data $D_{IN}$ depend on the coefficient of change $\alpha$ in the calculation of the weighted average. The luminance value $Y_j^{<Y2>}$ of pixel #j in the square-mean-calculation luminance image is equal to the square-mean-calculation alternative luminance value $Y^{APL_SUB}$ when the coefficient of change $\alpha$ is zero, and equal to the luminance value $Y_j$ of pixel #j in the luminance image corresponding to the input image data $D_{IN}$ when the coefficient of change α is one. The luminance value $Y_j^{APL}$ of pixel #j in the APL-calculation luminance image is determined as a value between the APL-calculation alternative luminance value $Y^{<Y2>_SUB}$ and the luminance value $Y_j$ of pixel #j in the luminance image corresponding to the input image data $D_{IN}$ when the coefficient of change α is a value between zero and one.

Figure 16:
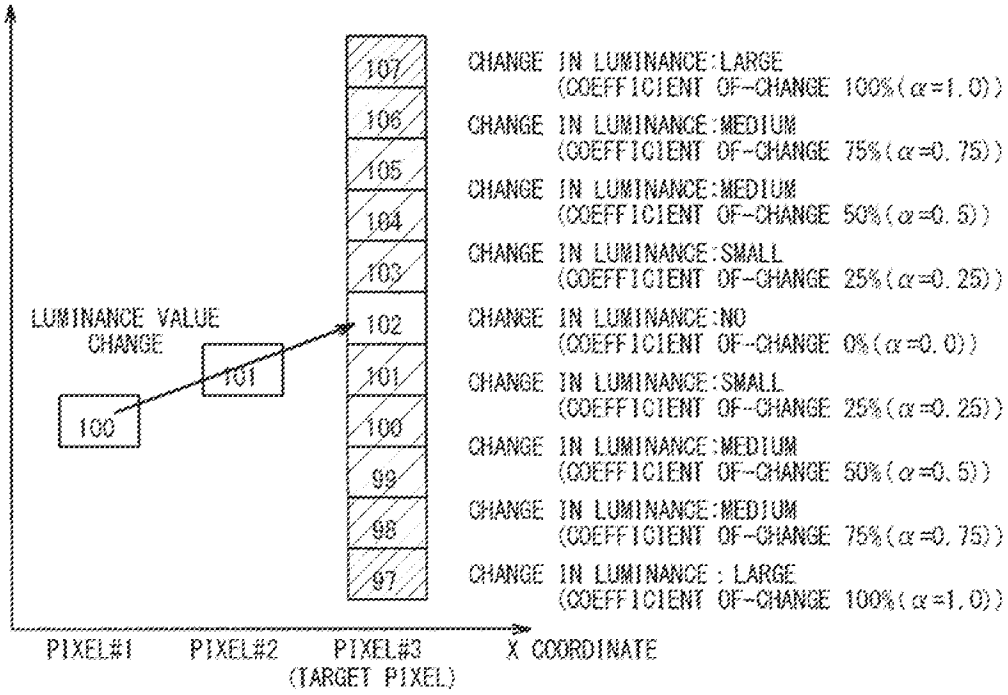
FIG. 16 is a schematic diagram illustrating the determination of a coefficient of change $\alpha$, which is used in the APL-calculating filtering process and the square-mean-calculating filtering process.

FIG. 16 is a schematic diagram illustrating the determination of the coefficient of change α, which is used in the APL-calculating filtering process and the square-mean-calculating filtering process. Let us assume that pixels #1 to #3 are arrayed in the X-axis directions (the direction in which the gate lines 7 are extended) and the luminance value of pixel #3, which is the target pixel, in the APL-calculation luminance image is determined depending on the differences of the luminance valve of pixel #3 from the luminance values of pixels #1 and #2 in the original image in the case when the luminance values of pixels #1 and #2 are 100 and 101, respectively.

In the example illustrated in FIG. 16, the coefficient of change α is determined as zero when there are substantially no differences between the luminance value of pixel #3 and those of pixels #1 and #2 in the original image, for example, when the luminance value of pixel #3 is 102. The coefficient of change α is determined as one when there are large differences between the luminance value of pixel #3 and those of pixels #1 and #2, for example, when the luminance value of pixel #3 is equal to or less than 97, or equal to or more than 107. The coefficient of change α is determined as a value between zero and one when there are medium differences between the luminance value of pixel #3 and those of pixels #1 and #2, for example, when the luminance value of pixel #3 ranges from 98 to 101 or from 103 to 106. In the example illustrated in FIG. 16, the coefficient of change α is selected from five different values.

Figure 17:
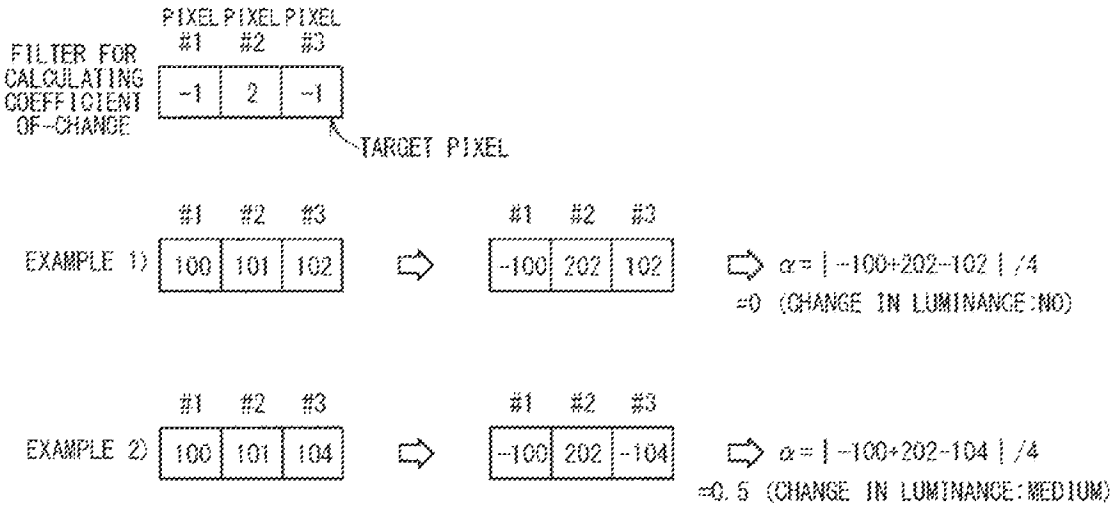
FIG. 17 illustrates one example of the procedure of calculating the coefficient of change $\alpha$ with a matrix filter.

FIG. 17 illustrates an example of the specific procedure of the calculation of the coefficient of change α. When the calculation of the coefficient of change α is implemented, in an actual device, the coefficient of change α may be calculated with a matrix filter as illustrated in FIG. 17. In one embodiment, the coefficient of change α associated with a certain target pixel is calculated on the basis of the absolute value $|Y_{SUM}|$ of the convolution sum $Y_{SUM}$ of the elements of the filter matrix and the luminance values of the target pixel and the pixels near the target pixel in the original image, in accordance with the following expressions (3):

$$\alpha=|Y_{SUM}|/K(\text{for } |Y_{SUM}|<K), \text{ and}$$

$$\alpha=1 \ (\text{for } |Y_{SUM}|\geq K), \tag{3}$$

where K is a predetermined coefficient (fixed value).

FIG. 17 illustrates one example of the matrix filter used for calculating the coefficient of change α. In one embodiment, the coefficient of change α associated with a certain target pixel may be calculated in accordance with expressions (3) from the convolution sum $Y_{SUM}$ of the elements of the filter matrix and the luminance values of a plurality of pixels 9 which are arrayed in the X-axis direction in the original image and include the target pixel. Note that one of the pixels 9 is the target pixel and the subpixels 11 of the pixels 9 are commonly connected with the same gate line 7.

Let us consider the case when pixels #1 to #3 are arrayed in the X-axis direction (that is, the sub-pixels 11 of pixels #1 to #3 are connected with the same gate line 7) and pixel #3 is selected as the target pixel, where pixel #2 is the pixel adjacent on the left of pixel #3 and pixel #1 is the pixel adjacent on the left of pixel #2. The coefficient of change α is calculated from the convolution sum $Y_{SUM}$ of the respective elements of a 1×3 filter matrix and the luminance values of pixels #1 to #3. The values of the respective elements of the filter matrix are defined as illustrated in FIG. 17 and the value of the coefficient K is set to four.

In Example 1 in which the luminance values of pixels #1, #2 and #3 in the original image are 100, 101 and 102, respectively, the convolution sum $Y_{SUM}$ is calculated as zero and the coefficient of change α is also calculated as zero. In Example 2 in which the luminance values of pixels #1, #2 and #3 in the original image are 100, 101 and 104, respectively, on the other hand, the convolution sum $|Y_{SUM}|$ is calculated as −2 (that is, the absolute value $|Y_{SUM}|$ of the convolution sum $Y_{SUM}$ is calculated as 2) and the coefficient of change α is calculated as 0.5.

In the configuration in which the coefficient of change α is calculated from the convolution sum $Y_{SUM}$ of the respective elements of a filter matrix and the luminance values of pixels 3 which include the target pixel and arrayed in the X-axis direction in the original image, the coefficient of change α can be calculated without using input image data $D_{IN}$ associated with pixels connected with the gate lines 7 adjacent to the gate line 7 connected with the target pixel. This preferably reduces the size of the circuit used for the calculation of the coefficient of change α.

Figure 18:
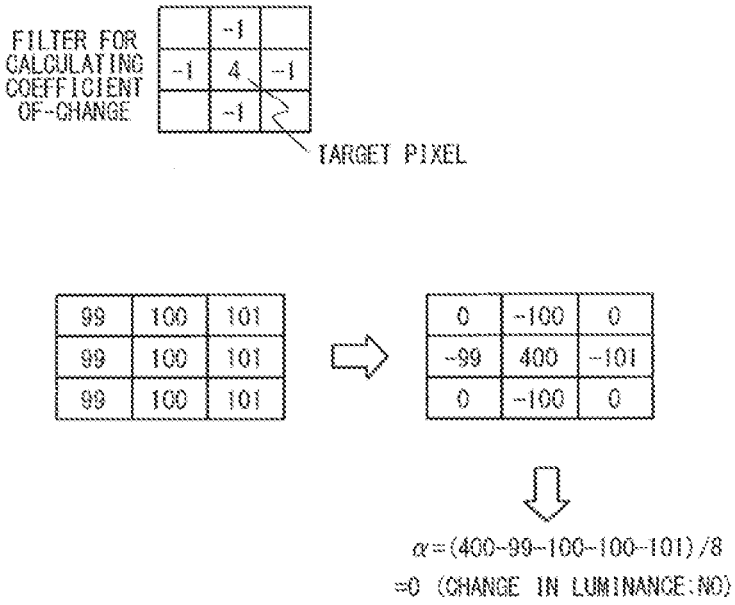
FIG. 18 illustrates another example of the procedure of calculating the coefficient of change $\alpha$ with a matrix filter.

Various matrixes may be used as a filter matrix used for the calculation of the coefficient of change α. FIG. 18 illustrates another example of the filter matrix used for the calculation of the coefficient of change α. In the example illustrated in FIG. 18, a 3×3 filter matrix is used and the coefficient K is set to eight. The coefficient of change α associated with a certain target pixel is calculated from the convolution sum $Y_{SUM}$ of the elements of the filter matrix and the luminance values of pixels arrayed in three rows and three columns in the original image in accordance with expression (3). Note that the target pixel is located at the center of the 3×3 pixel array. In the example illustrated in FIG. 18, the convolution sum $Y_{SUM}$ is calculated as zero and the coefficient of change is also calculated as zero.

(Step S11)

At step S11, area characterization data $D_{CHR_AREA}$ associated with each area are calculated from the APL-calculation image data obtained by the APL-calculating filtering process and the square-mean-calculation image data obtained by the square-mean-calculating filtering process. As described above, APL data of area characterization data $D_{CHR_AREA}$ associated with each area are calculated from the APL-calculation image data and square-mean data of area characterization data $D_{CHR_AREA}$ associated with each area are calculated from the square-mean calculation image data.

More specifically, in the present embodiment, APL data of area characterization data $D_{CHR_AREA}$ associated with the area A(N, M) (that is, APL(N, M) of the area A(N, M)) are calculated in accordance with the following expression (4):

$$APL(N, M) = \frac{\sum Y_j^{APL}}{\text{Data_Count}} \tag{4}$$

where Data_count is the number of pixels 9 located in the area A (N, M), $Y_j^{APL}$ is the luminance value of each pixel 9 in the APL-calculation luminance image and Σ represents the sum with respect to area A(N, M).

On the other hand, square-mean data of area characterization data $D_{CHR_AREA}$ associated with the area A (N, M) (that is, the mean of squares $<Y^2>$ (N, M) of the luminance values of the pixels located in the area A(N, M)) are calculated in accordance with the following expression (5):

$$\langle Y^2\rangle(N, M) = \frac{\sum (Y_j^{\langle Y2\rangle})^2}{\text{Data_Count}} \tag{5}$$

where Data_count in the number of pixels 9 located in the area A(N, M), $Y_j^{<Y2>}$ is the luminance value of each pixel 9 in the square-mean-calculation luminance image and Σ represents the sum with respect to area A(N, M).

(Step S12)

At step S12, filtered characterization data $D_{CHR_FILTER}$ are calculated from the area characterization data $D_{CHR_AREA}$ calculated at step S11. As described above, filtered characterization data $D_{CHR_FILTER}$ are calculated for each vertex of each area defined in the display region 5. The filtered characterization data $D_{CHR_FILTER}$ associated with a certain vertex are calculated from the area characterization data $D_{CHR_AREA}$ associated with one or more areas which the certain vertex belongs to. This implies that the filtered characterization data $D_{CHR_FILTER}$ associated with a certain vertex indicate the feature quantities of an image displayed in the region around the certain vertex. In the present embodiment, the area characterization data $D_{CHR_AREA}$ include APL data and square-mean data and filtered characterization data $D_{CHR_AREA}$ include APL data and variance data.

As understood from FIG. 11, a vertex may belong to a plurality of areas, and the number of areas which the vertex belongs to depends on the position of the vertex. In the present embodiment, there are three types of vertices in the display region 5 and the calculation method of the filtered characterization data $D_{CHR_FILTER}$ associated with a certain vertex depends on the type of the vertex. In the following, a description is given of the calculation method of the filtered characterization data $D_{CHR_FILTER}$ associated with each vertex.

(1) Vertices Located at the Four Corners of the Display Region 5

Referring to FIG. 11, the four vertices VTX(0, 0), VTX(0, Mmax), VTX(Nmax, 0), and VTX(Nmax, Mmax) positioned at the four corners of the display region 5 each belong to a single area, where Nmax and Mmax are the maximum values of the indices N and M which respectively represent the row and column in which the vertex is positioned; in the present embodiment, in which the vertices are arrayed in seven rows and seven columns, Nmax and Mmax are both six.

The area characterization data $D_{CHR_AREA}$ associated with the areas which the four vertices at the four corners of the display region 5 respectively belong to are used as filtered characterization data $D_{CHR_FILTER}$ associated with the four vertices, without modification. On the other hand, variance data of filtered characterization data $D_{CHR_FILTER}$ associated with each of the four vertices are calculated as data indicating the variance of the luminance values in the area which each of the four vertices belongs to; variance data of filtered characterization data $D_{CHR_FILTER}$ associated with each of the four vertices are calculated from the APL data and square-mean data of the area characterization data $D_{CHR_AREA}$. More specifically, the APL data and variance data of the filtered characterization data $D_{CHR_FILTER}$ are obtained as follows:

$$APL_\text{FILTER}(0,0)=APL(0,0), \tag{6a}$$

$$\sigma^2_\text{FILTER}(0,0)=\sigma^2(0,0), \tag{6b}$$

$$APL_\text{FILTER}(0,M\text{max})=APL(0,M\text{max}-1), \tag{6c}$$

$$\sigma^2_\text{FILTER}(0,M\text{max})=\sigma^2(0,M\text{max}-1), \tag{6d}$$

$$APL_\text{FILTER}(N\text{max},0)=APL(N\text{max}-1,0), \tag{6e}$$

$$\sigma^2_\text{FILTER}(N\text{max},0)=\sigma^2(N\text{max}-1,0), \tag{6 f}$$

$$APL_\text{FILTER}(N\text{max},M\text{max})=APL(N\text{max}-1,M\text{max}-1), \text{ and} \tag{6g}$$

$$\sigma^2_\text{FILTER}(N\text{max},M\text{max})=\sigma^2(N\text{max}-1,M\text{max}-1), \tag{6h}$$

where APL_FILTER (i, j) is the value of APL data associated with the vertex VTX(i, j) and $\sigma^2$FILTER(i, j) is the value of variance data associated with the vertex VTX(i, j). As described above, APL(i, j) is the APL of the area A(i, j) and $\sigma^2$(i, j) is the variance of the luminance values of the pixels 9 in the area A(i, j) and obtained by the following expression (A):

$$\sigma^2(i,j)=<Y^2>(i,j)-\{APL(i,j)\}^2. \tag{A}$$

(2) The Vertices Positioned on the Four Sides of the Display Region 5

The vertices positioned on the four sides of the display region 5 (in the example illustrated FIG. 11, the vertices VTX(0, 1)-VTX(0, Mmax−1), VTX(Nmax, 1)-VTX(Nmax, Mmax−1), VTX(1, 0)-VTX(Nmax−1, 0) and VTX (1, Mmax) to VTX(Nmax−1, Mmax)) belong to the adjacent two areas. APL data of filtered characterization data $D_{CHR_FILTER}$ associated with the vertices positioned on the four sides of the display region 5 are respectively defined as the average values of the APL data of the area characterization data $D_{CHR_AREA}$ associated with the two adjacent areas to which the vertices each belong to, and variance data of filtered characterization data $D_{CHR_FILTER}$ associated with the vertices positioned on the four sides of the display region 5 are calculated from the APL data and square-mean data of the area characterization data $D_{CHR_AREA}$ associated with the two adjacent areas to which the vertices each belong to. More specifically, the APL data and variance data of filtered characterization data $D_{CHR_FILTER}$ associated with the vertices positioned on the four sides of the display region 5 are obtained as follows:

$$APL_\text{FILTER}(0,M)=\{APL(0,M-1)+APL(0,M)\}/2, \tag{7a}$$

$$\sigma^2_\text{FILTER}(0,M)=\{\sigma^2(0,M-1)+\sigma^2(0,M)\}/2, \tag{7b}$$

$$APL_\text{FILTER}(N,0)=\{APL(N-1,0)+APL(N,0)\}/2, \tag{7c}$$

$$\sigma^2_\text{FILTER}(N,0)=\{\sigma^2(N-1,0)+\sigma^2(N,0)\}/2, \tag{7d}$$

$$APL_\text{FILTER}(N\text{max},M)=\{APL(N\text{max},M-1)+APL(N\text{max},M)\}/2, \tag{7e}$$

$$\sigma^2_\text{FILTER}(N\text{max},M)=\{\sigma^2(N\text{max},M-1)+\sigma^2(N\text{max},M)\}/2, \tag{7f}$$

$$APL_\text{FILTER}(N,M\text{max})=\{APL(N-1,M\text{max})+APL(N,M\text{max})\}/2, \text{ and} \tag{7g}$$

$$\sigma^2_\text{FILTER}(N,M\text{max})=\{\sigma^2(N-1,M\text{max})+\sigma^2(N,M\text{max})\}/2, \tag{7h}$$

where M is an integer from one to Mmax−1 and N is an integer from one to Mmax−1. Note that $\sigma^2(i, j)$ is given by the above-described expression (A).

(3) The Vertices Other Than Those Described Above

The vertices which are located neither at the four corners of the display region 5 nor on the four sides (that is, the vertices located at intermediate positions) each belong to adjacent four areas arrayed in two rows and two columns. APL data of filtered characterization data $D_{CHR_FILTER}$ associated with the vertices which are located neither at the four corners of the display region 5 nor on the four sides are respectively defined as the average values of the APL data of the area characterization data $D_{CHR_AREA}$ associated with the four areas to which the vertices each belong to, and variance data of filtered characterization data $D_{CHR_FILTER}$ associated with such vertices are calculated from the APL data and square-mean data of the area characterization data $D_{CHR_AREA}$ associated with the four areas to which the vertices each belong to. More specifically, the APL data and variance data of filtered characterization data $D_{CHR_FILTER}$ associated with this type of vertices are obtained as follows:

$$APL_\mathrm{FILTER}(N,M)=\{APL(N-1,M-1)+APL(N-1,M)+APL(N,M-1)+APL(N,M)\}/4, \text{ and} \tag{8a}$$

$$\sigma^2_\mathrm{FILTER}(N,M)=\{\sigma^2(N-1,M-1)+\sigma^2(N-1,M)+\sigma^2(N,M-1)+\sigma^2(N,M)\}/4. \tag{8b}$$

Note that $\sigma^2(i, j)$ is given by the above-described expression (A).

(Step S13)

At step S13, pixel-specific characterization data $D_{CHR_PIXEL}$ associated with each pixel 9 is calculated with a linear interpolation of the filtered characterization data $D_{CHR_FILTER}$ calculated at Step S12, depending on the position of each pixel 9 in each area. In the present embodiment, the filtered characterization data $D_{CHR_FILTER}$ include APL data and variance data, and accordingly the pixel-specific data $D_{CHR_PIXEL}$ also include APL data and variance data calculated for the respective pixels 9.

Figure 19:
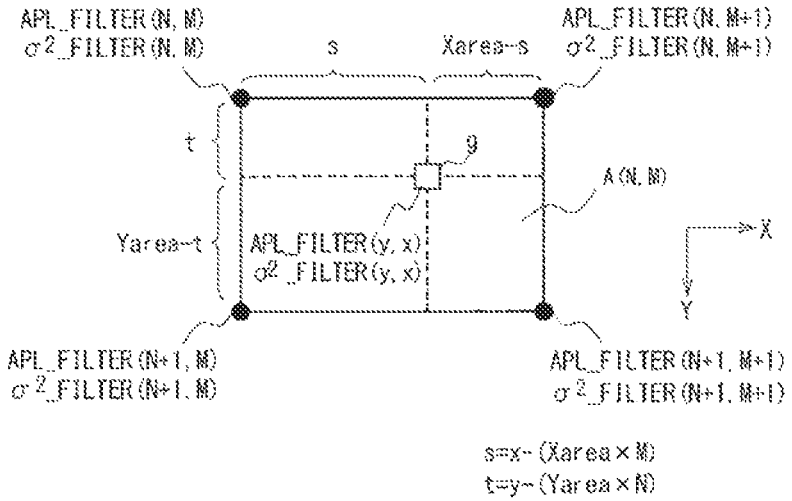
FIG. 19 is a conceptual diagram illustrating an exemplary calculation method of pixel-specific characterization data in the present embodiment.

FIG. 19 is a conceptual diagram illustrating an exemplary calculation method of pixel-specific characterization data $D_{CHR_PIXEL}$ associated with a certain pixel 9 positioned in the area A(N, M).

In FIG. 19, s indicates the position of the pixel 9 in the area A(N, M) in the X-axis direction, and t indicates the position of the pixel 9 in the area A(N, M) in the Y-axis direction. The positions s and t are represented as follows:

$$s=x-(X\mathrm{area}\times M), \text{ and} \tag{9a}$$

$$t=y-(Y\mathrm{area}\times N), \tag{9b}$$

where x is the position represented in units of pixels in the display region 5 in the X-axis direction, Xarea is the number of pixels arrayed in the X-axis direction in each area, y is the position represented in units of pixels in the display region 5 in the Y-axis direction, and Yarea is the number of pixels arrayed in the Y-axis direction in each area. As described above, when the display region 5 of the LCD panel 2 includes 1920×1080 pixels and is divided into areas arrayed in six rows and six columns, Xarea (the number of pixels arrayed in the X-axis direction in each area) is 320 (=1920/6) and Yarea (the number of pixels arrayed in the Y-axis direction in each area) is 180 (=1080/6).

The pixel-specific characterization data $D_{CHR_PIXEL}$ associated with each pixel 9 positioned in the area A(N, M) are calculated by applying a linear interpolation to the filtered characterization data $D_{CHR_FILTER}$ associated with the four vertices of the area A(N, M) in accordance with the position of the specific pixel 9 in the area A(N, M). More specifically, pixel-specific characterization data $D_{CHR_PIXEL}$ associated with a specific pixel 9 in the area A(N, M) are calculated in accordance with the following expressions:

$$\mathrm{APL_PIXEL}(y, x) = \frac{(Yarea-t)}{Yarea}\times\frac{\mathrm{APL_FILTER}(N, M+1)\times s+\mathrm{APL_FILTER}(N, M)\times(Xarea-s)}{Xarea}+\frac{t}{Yarea}\times\frac{\mathrm{APL_FILTER}(N+1, M+1)\times s+\mathrm{APL_FILTER}(N+1, M)\times(Xarea-s)}{Xarea} \tag{10a}$$

$$\sigma^2_\mathrm{PIXEL}(y, x) = \frac{(Yarea-t)}{Yarea}\times\frac{\sigma^2_\mathrm{FILTER}(N, M+1)\times s+\sigma^2_\mathrm{FILTER}(N, M)\times(Xarea-s)}{Xarea}+\frac{t}{Yarea}\times\frac{\sigma^2_\mathrm{FILTER}(N+1, M+1)\times s+\sigma^2_\mathrm{FILTER}(N+1, M)\times(Xarea-s)}{Xarea} \tag{10b}$$

where APL_PIXEL(y, x) is the value of APL data calculated for a pixel 9 positioned at an X-axis direction position x and a Y-axis direction position y in the display region 5 and $\sigma^2$_PIXEL(y, x) is the value of variance data calculated for the pixel 9.

The above-described processes at steps S12 and S13 would be understood as a whole as processing to calculate pixel-specific characterization data $D_{CHR_PIXEL}$ associated with each pixel 9 by applying a sort of filtering to the area characterization data $D_{CHR_AREA}$ associated with the area in which each pixel 9 is located and the area characterization data $D_{CHR_AREA}$ associated with the areas around (or adjacent to) the area in which each pixel 9 is located, depending on the position of each pixel 9 in the area in which each pixel 9 is located.

(At Step S14)

At step S14, the gamma values to be used for the gamma correction of input image data $D_{IN}$ associated with each pixel 9 is calculated from the APL data of the pixel-specific characterization data $D_{CHR_PIXEL}$ associated with each pixel 9. In the present embodiment, a gamma value is individually calculated for each of the R subpixel 11R, G subpixel 11G and B subpixel 11B of each pixel 9. More specifically, the gamma value to be used for the gamma correction of input image data $D_{IN}$ associated with the R subpixel 11R of a certain pixel 9 positioned at the X-axis direction position x and the Y-axis direction position y in the display region 5 is calculated in accordance with the following expression:

$$\gamma_\mathrm{PIXEL}^R=\gamma_\mathrm{STD}^R+APL_\mathrm{PIXEL}(y,x)\cdot\eta^R, \tag{11a}$$

where $\gamma_\mathrm{PIXEL}^R$ is the gamma value to be used for the gamma correction of the input image data $D_{IN}$ associated with the R subpixel 11R of the certain pixel 9, $\gamma_\mathrm{STD}^R$ is a given reference gamma value and $\eta^R$ is a given positive proportionality constant. It should be noted that, in accordance with expression (11a) (the gamma value $\gamma_\mathrm{PIXEL}^R$ increases as APL_PIXEL(y, x) increases.

Correspondingly, the gamma values to be used for the gamma corrections of input image data $D_{IN}$ associated with the G subpixel 11G and B subpixel 11B of the certain pixel 9 positioned at the X-axis direction position x and the Y-axis direction position y in the display region 5 are respectively calculated in accordance with the following expressions:

$$\gamma_PIXEL^G=\gamma_STD^G+APL_PIXEL(y,x)\cdot\eta^G, \text{ and} \tag{11b}$$

$$\gamma_PIXEL^B=\gamma_STD^B+APL_PIXEL(y,x)\cdot\eta^B, \tag{11c}$$

where $\gamma_PIXEL^G$ and $\gamma_PIXEL^B$ are the gamma values to be respectively used for the gamma corrections of the input image data $D_{IN}$ associated with the G subpixel 11G and B subpixel 11B of the certain pixel 9, $\gamma_STD^G$ and $\gamma_STD^B$ are given reference gamma values and $\eta^G$ and $\eta^B$ are given proportionality constants. $\gamma_STD^R$, $\gamma_STD^G$ and $\gamma_STD^B$ may be equal to each other, or different, and $\eta^R$, $\eta^G$ and $\eta^B$ may be equal to each other, or different. It should be noted that the gamma values $\gamma_PIXEL^R$, $\gamma_PIXEL^G$ and $\gamma_PIXEL^B$ are calculated for each pixel 9.

(Step S15)

At step S15, correction point data sets $CP_L^R$, $CP_L^G$ and $CP_L^B$ are selected or determined on the basis of the calculated gamma values $\gamma_PIXEL^R$, $\gamma_PIXEL^G$ and $\gamma_PIXEL^B$, respectively. It should be noted that the correction point data sets $CP_L^R$, $CP_L^G$ and $CP_L^B$ are seed data used for calculating the correction point data sets $CP_sel^R$, $CP_sel^G$ and $CP_sel^B$, which are finally fed to the approximate gamma correction circuit 22. The correction point data sets $CP_L^R$, $CP_L^G$ and $CP_L^B$ are determined for each pixel 9.

In one embodiment, the correction point data sets $CP_L^R$, $CP_L^G$ and $CP_L^B$ are determined as follows: A plurality of correction point data sets CP#1 to CP#m are stored in the correction point data set storage register 41 of the correction point data calculation circuit 29 and the correction point data sets $CP_L^R$, $CP_L^G$ and $CP_L^B$ are each selected from among the correction point data sets CP#1 to CP#m. As described above, the correction point data sets CP#1 to CP#m correspond to different gamma values γ and each of the correction point data sets CP#1 to CP#m includes correction point data CP0 to CP5.

The correction point data CP0 to CP5 of a correction point data set CP#j corresponding to a certain gamma value γ are determined as follows:

(1) For $\gamma < 1$, (12a)

$$CP0 = 0$$
$$CP1 = \frac{4\cdot\text{Gamma}[K/4] - \text{Gamma}[K]}{2}$$
$$CP2 = \text{Gamma}[K-1]$$
$$CP3 = \text{Gamma}[K]$$
$$CP4 = 2\cdot\text{Gamma}[(D_{IN}^{MAX} + K - 1)/2] - D_{OUT}^{MAX}$$
$$CP5 = D_{OUT}^{MAX}$$

and (2) For $\gamma \geq 1$, (12b)

$$CP0 = 0$$
$$CP1 = 2\cdot\text{Gamma}[K/2] - \text{Gamma}[K]$$
$$CP2 = \text{Gamma}[K-1]$$
$$CP3 = \text{Gamma}[K]$$
$$CP4 = 2\cdot\text{Gamma}[(D_{IN}^{MAX} + K - 1)/2] - D_{OUT}^{MAX}$$
$$CP5 = D_{OUT}^{MAX}$$

where $D_{IN}^{MAX}$ is the allowed maximum value of the input image data $D_{IN}$ and depends on the number of bits of the input image data $D_{IN}^R$, $D_{IN}^G$ and $D_{IN}^B$. Similarly, $D_{OUT}^{MAX}$ is the allowed maximum value of the output image data $D_{OUT}$ and depends on the number of bits of the output image date $D_{OUT}^R$, $D_{OUT}^G$ and $D_{OUT}^B$. K is a constant given by the following expression:

$$K=(D_{IN}^{MAX}+1)/2. \tag{13a}$$

In the above, the function Gamma [x], which is a function corresponding to the strict expression of the gamma correction, is defined by the following expression:

$$\text{Gamma}[x]=D_{OUT}^{MAX}\cdot(x/D_{IN}^{MAX})^{\gamma} \tag{13b}$$

In the present embodiment, the correction point data sets CP#1 to CP#m are determined so that the gamma value γ recited in expression (13b) to which a correction point data set CP#j selected from the correction point data sets CP#1 to CP#m corresponds is increased as j is increased. In other words, it holds:

$$\gamma_1<\gamma_2< \cdots \gamma_{m-1}<\gamma_m, \tag{14}$$

where $\gamma_j$ is the gamma value corresponding to the correction point data set CP#j.

In one embodiment, the correction point data set $CP_L^R$ selected from the correction point data sets CP#1 to CP#m on the basis of the gamma value $\gamma_PIXEL^R$. The correction point data set $CP_L^R$ is determined as a correction point data set CP#j with a larger value of j as the gamma value $\gamma_PIXEL^R$ increases. Correspondingly, the correction point data sets $CP_L^G$ and $CP_L^B$ are selected from the correction point data sets CP#1 to CP#m on the basis of the gamma values $\gamma_PIXEL^G$ and $\gamma_PIXEL^B$, respectively.

Figure 20:
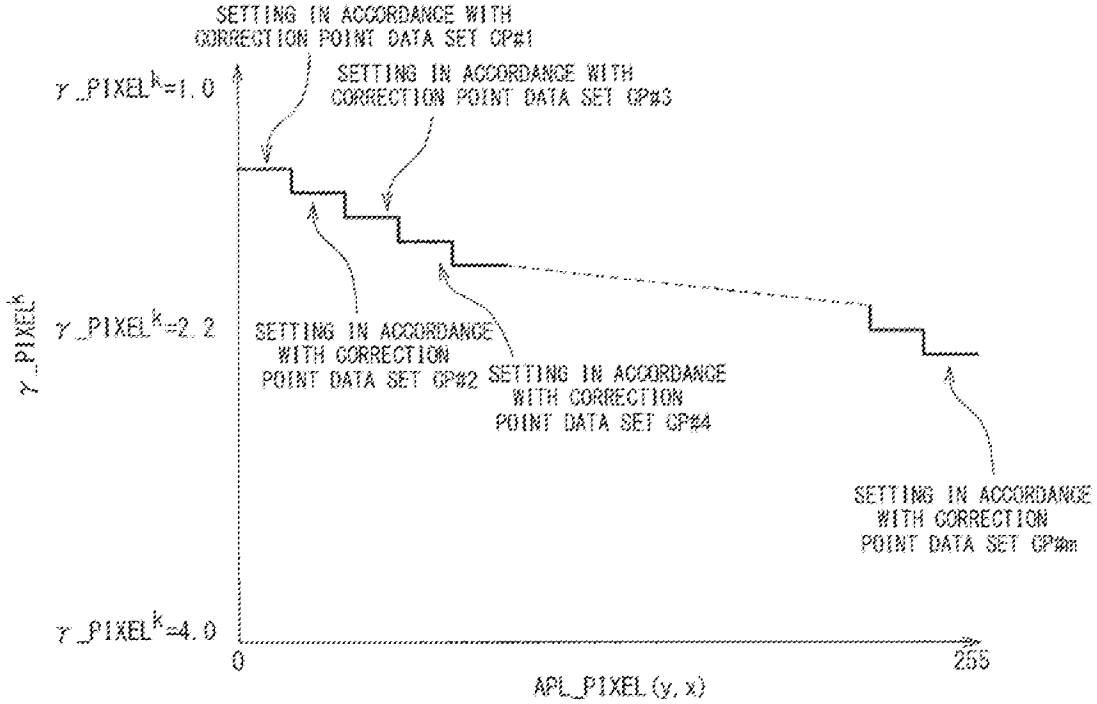
FIG. 20 is a graph illustrating the relation among APL_PIXEL(y, x), $\gamma$_PIXEL$^k$ and the correction point data set CP_L$^k$ in one embodiment.

FIG. 20 is a graph illustrating the relation among APL_PIXEL(y, x), $\gamma_PIXEL^k$ and the correction point data set $CP_L^k$ in the case when the correction point data set $CP_L^k$ is determined in this manner. As the value of APL_PIXEL(y, x) increases, the gamma value $\gamma_PIXEL^k$ is increased and a correction point data set CP#j with a larger value of j is selected as the correction point data set $CP_L^k$.

In an alternative embodiment, the correction point data sets $CP_L^R$, $CP_L^G$ and $CP_L^B$ may be determined as follows: The correction point data sets CP#1 to CP#m are stored in the correction point data set storage register 41 of the correction point data calculation circuit 29. The number of the correction point data sets CP#1 to CP#m stored in the correction point data set storage register 41 is $2^{P-(Q-1)}$, where P is the number of bits used to describe APL_PIXEL (y, x) and Q is a predetermined integer equal to more than two and less than P. This implies that $m=2^{P-(Q-1)}$. The correction point data sets CP#1 to CP#m to be stored in the correction point data set storage register 41 may be fed from the processor 4 to the drive IC 3 as initial settings.

Furthermore, two correction point data sets CP#q and CP#(q+1) are selected on the basis of the gamma value $\gamma_PIXEL^k$ (k is any one of "R", "G" and "B") from among the correction point data sets CP#1 to CP#m stored in the correction point data set storage register 41 for determining the correction point data set $CP_L^k$, where g is an integer from one to m−1. The two correction point data sets CP#q and CP#(q+1) are selected to satisfy the following expression (15):

$$\gamma_q<\gamma_PIXEL^k<\gamma_{q+1}. \tag{15}$$

The correction point data CP0 to CP5 of the correction point data sot $CP_L^k$ are respectively calculated with an interpolation of correction point data CP0 to CP5 of the selected two correction point data sets CP#q and CP#(q+1).

More specifically, the correction point data CP0 to CP5 of the correction point data set $CP_L^k$ (where k is any of "R", "G" and "B") are calculated from the correction point data CP0 to CP5 of the selected two correction point data sets CP#q and CP#(q+1) in accordance with the following expressions:

$$CP\alpha_L^K = CP\alpha(\#q) + \{(CP\alpha(\#(q+1)) - CP\alpha(\#q))/2^Q\} \times APL_PIXEL[Q-1:0], \quad (16)$$

where ● is an integer from aero to five, CP●_$L^k$ is the correction point data CP● of correction point data set CP_$L^k$, CP●(#q) is the correction point data CP● of the selected correction point data set CP#q, CP●(#(q+1)) is the correction point data CP● of the selected correction point data set CP#(q+1), and APL_PIXEL[Q−1:0] is the lowest Q bits of APL_PIXEL (y, x).

Figure 21:
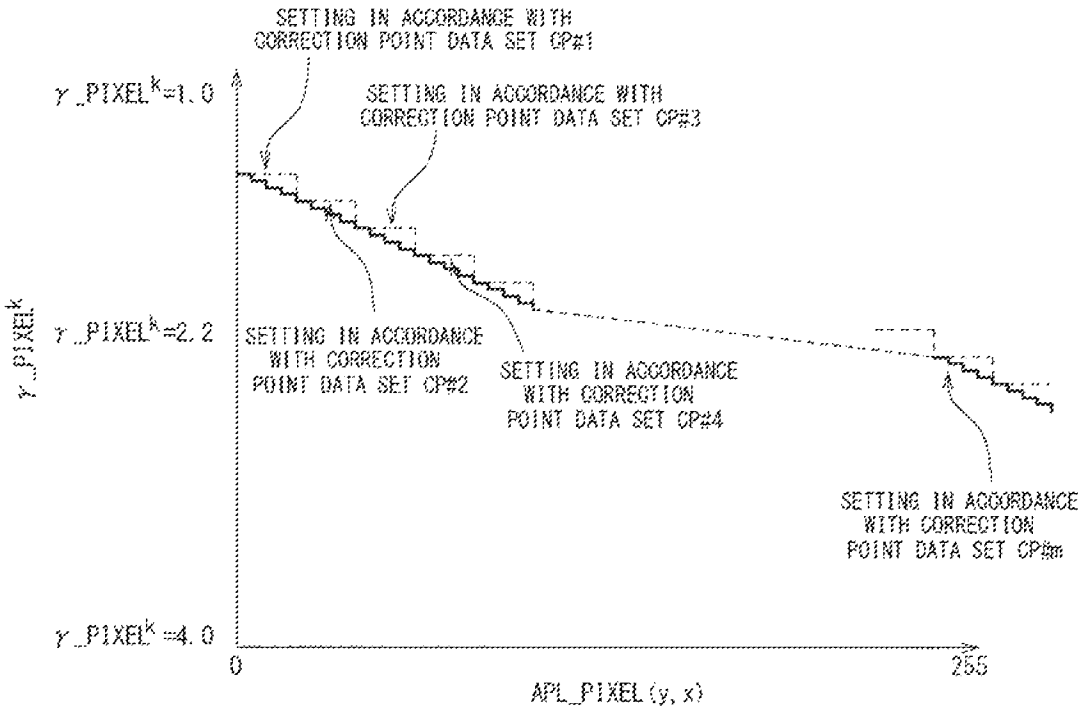
FIG. 21 is a graph illustrating the relation among APL_PIXEL(y, x), $\gamma$_PIXEL$^k$ and the correction point data set CP_L$^k$ in another embodiment.

FIG. 21 is a graph illustrating the relation among APL_PIXEL(y, x) , γ_PIXEL$^k$ and the correction point data set CP_$L^k$ in the case when the correction point data set CP_$L^k$ is determined in this manner. As the value of APL_PIXEL(y, x) increases, the gamma value γ_PIXEL$^k$ is increased and correction point data sets CP#q and CP#(q+1) with a larger value of q are selected. The correction point data set CP_$L^k$ is determined to correspond to a gamma value in a range from the gamma value $\gamma_q$ to $\gamma_{q+1}$, which the correction point data seta CP#q and CP#(q+1) correspond to, respectively.

Figure 22:
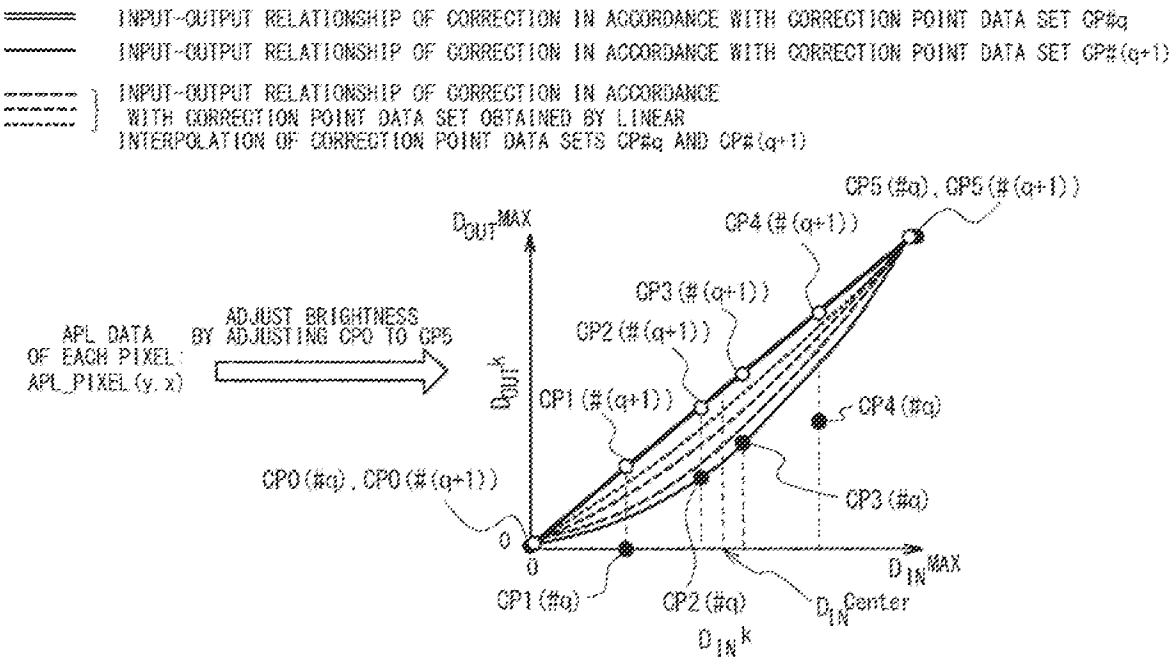
FIG. 22 is a graph schematically illustrating the shapes of the gamma curves corresponding to the correction point data sets CP#q and CP#(q+1) and the correction point, data set CP_L$^k$.

FIG. 22 is a graph schematically illustrating the shapes of the gamma curves corresponding to the correction point data sets CP#q and CP#(q+1) and the correction point data set CP_$L^k$. Since the correction point data CPα of the correction point data set CP_$L^k$ is obtained through the interpolation of the correction point data CPα(#q) and CPα(#(q+1)) of the correction point data sets CP#q and CP#(q+1), the shape of the gamma curve corresponding to the correction point data set CP_$L^k$ is determined so that the gamma curve corresponding to the correction point data set CP_$L^k$ is located between the gamma curves corresponding to the correction point data sets CP#q and CP#(q+1). The calculation of the correction point data CP0 to CP5 of the correction point data set CP_$L^k$ through the interpolation of the correction point data CP0 to CP5 of the correction point data sets CH#q and CP#(q+1) is advantageous for allowing finely adjusting the gamma value used for the gamma correction even when only a reduced number of the correction point data sets CP#1 to CP#m are stored in the correction point data set storage register 41.

(Step S16)

At step S16, the correction point data set CP_$L^k$ (where k is any of "R", "G" and "B") determined at step S15 are modified on the basis of variance data σ$^2$_PIXEL(y, x) included in the pixel-specific characterization data $D_{CHR_PIXEL}$ to thereby calculate the correction point data set CP_sel$^k$, which is finally fed to the approximate gamma correction circuit 22. The correction point data set CP_sel$^k$ is calculated for each pixel 9. It should be noted that, since the correction point data set CP_$L^k$ is a data set which represents the shape of a specific gamma curve as described above, the modification of the correction point data set CP_$L^k$ based on the variance data σ$^2$_PIXEL(y, x) is technically considered as equivalent to a modification of the gamma curve used for the gamma correction based on the variance data σ$^2$_PIXEL(y, x).

Figure 23:
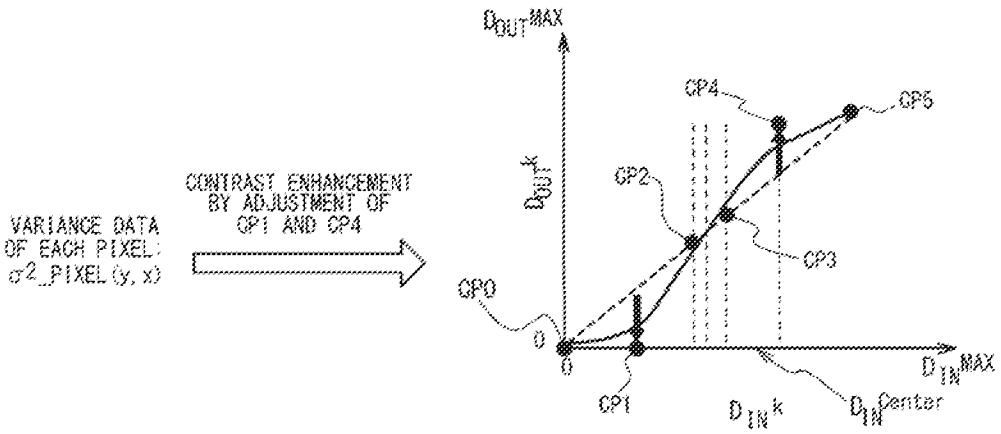
FIG. 23 is a conceptual diagram illustrating a technical meaning of the modification of the correction point data set CP_L$^k$ on the basis of the variance data $\sigma^2$–PIXEL(y, x).

FIG. 23 is a conceptual diagram illustrating a technical meaning of the modification of the correction point data set CP_$L^k$ based on the variance data σ$^2$_PIXEL (y, x). An reduced value of variance data σ$^2$_PIXEL(y, x) associated with a certain pixel 9 implies that an increased number of pixels 9 have luminance values close to the APL_PIXEL (y, x) around the certain pixel 9; in other words, the contrast of the image is small. When the contrast of the image corresponding to the input image data $D_{IN}$ is small, it is possible to display the image with an improved image quality by performing a correction calculation to enhance the contrast by the approximate gamma correction circuit 22.

Since the correction point data CP1 and CP4 of the correction point data set CP_$L^k$ largely influence the contrast, the correction point data CP1 and CP4 of the correction point data set CP_$L^k$ are adjusted on the basis of the variance data σ$^2$_PIXEL(y, x) in the present embodiment. The correction point data CP1 of the correction point data set CP_$L^k$ is modified so that the correction point data CP1 of the correction point data set CP_sel$^k$, which is finally fed to the approximate gamma correction circuit 22, is decreased as the value of the variance data σ$^2$_PIXEL(y, x) decreases. The correction point data CP4 of the correction point data set CP_$L^k$ is, on the other hand, modified so that the correction point data CP4 of the correction point data set CP_sel$^k$, which is finally fed to the approximate gamma correction circuit 22, is increased as the value of the variance data σ$^2$_PIXEL(y, x) decreases. Such modification results in that the correction calculation in the approximate gamma correction circuit 22 is performed to enhance the contrast, when the contrast of the image corresponding to the input image data $D_{IN}$ is small. It should be noted that the correction point data CP0, CP2, CP3 and CP5 of the correction point data set CP_$L^k$ are not modified in the present embodiment. In other words, the values of the correction point data CP0, CP2, CP3 and CP5 of the correction point data set CP_sel$^k$ are equal to the correction point data CP0, CP2, CP3 and CP5 of the correction point data set CP_$L^k$, respectively.

In one embodiment, the correction point data CP1 and CP4 of the correction point data set CP_sel$^k$ are calculated in accordance with the following expressions:

$$CP1_sel^R = CP1_L^R - (D_{IN}^{MAX} - \sigma^2_PIXEL(y,x)) \cdot \xi^R, \quad (17a)$$

$$CP1_sel^G = CP1_L^G - (D_{IN}^{MAX} - \sigma^2_PIXEL(y,x)) \cdot \xi^G, \quad (17b)$$

$$CP1_sel^B = CP1_L^B - (D_{IN}^{MAX} - \sigma^2_PIXEL(y,x)) \cdot \xi^B, \quad (17c)$$

$$CP4_sel^R = CP4_L^R + (D_{IN}^{MAX} - \sigma^2_PIXEL(y,x)) \cdot \xi^R, \quad (18a)$$

$$CP4_sel^G = CP4_L^G + (D_{IN}^{MAX} - \sigma^2_PIXEL(y,x)) \cdot \xi^G, \quad (18b)$$

and $$CP4_sel^B = CP4_L^B + (D_{IN}^{MAX} - \sigma^2_PIXEL(y,x)) \cdot \xi^B, \quad (18c)$$

where $D_{IN}^{MAX}$ is the allowed maximum value of the input image data $D_{IN}$ as described above, and $\xi^R$, $\xi^G$, and $\xi^B$ are given proportionality constants; the proportionality constants $\xi^R$, $\xi^G$, and $\xi^B$ may be equal to each other, or different. Note that CP1_sel$^k$ and CP4_$L^k$ are correction point, data CP1 and CP4 of the correction point data set CP_$L^k$ and CP1_$L^k$ and CP4_$L^k$ are correction point data CP1 and CP4 of the correction point data set CP_$L^k$.

(Step S17)

At step S17, a correction calculation is performed on input image data $D_{IN}^R$, $D_{IN}^G$ and $D_{IN}^B$ associated with each pixel 9 on the basis of the correction point data sets CP_sel$^R$, CP_sel$^G$ and CP_sel$^B$ calculated at step S16 for each pixel 9, respectively, to thereby generate the output image data $D_{OUT}^R$, $D_{OUT}^G$ and $D_{OUT}^B$. This correction is performed by the approximate gamma correction units 22R, 22G and 22B.

In the correction calculation at step S17, the output image data $D_{OUT}^{k}$ are calculated from the input image data $D_{IN}^{k}$ in accordance with the following expressions.

(1) For the case when $D_{IN}^{k}<D_{IN}^{Center}$ and CP1>CP0

$$D_{OUT}^{k}=\frac{2(CP1-CP0)\cdot PD_{INS}}{K^2}+\frac{(CP3-CP0)D_{INS}}{K}+CP0 \quad (19a)$$

It should be noted that the fact that the value of the correction point data CP0 is larger than that of the correction point data CP1 implies that the gamma value γ used for the gamma correction is smaller than one.

(2) For the case when $D_{IN}^{k}<D_{IN}^{Center}$ and CP1≤CP0

$$D_{OUT}^{k}=\frac{2(CP1-CP0)\cdot ND_{INS}}{K^2}+\frac{(CP3-CP0)D_{INS}}{K}+CP0 \quad (19b)$$

It should be noted that the fact that the value of the correction point data CP0 is equal to or less than that of the correction point data CP1 implies that the gamma value γ used for the gamma correction is equal to or larger than one.

(3) For the case when $D_{IN}^{k}>D_{IN}^{Center}$ $$D_{OUT}^{k}=\frac{2(CP4-CP2)\cdot ND_{INS}}{K^2}+\frac{(CP5-CP2)D_{INS}}{K}+CP2 \quad (19c)$$

In the above, the center data value $D_{IN}^{Center}$ is a value defined by the following expression:

$$D_{IN}^{Center}=D_{IN}^{MAX}/2, \quad (20)$$

where $D_{IN}^{MAX}$ is the allowed maximum value and K is the parameter given by the above-described expression (13a). Furthermore, $D_{INS}$, $PD_{INS}$, and $ND_{INS}$ recited in expressions (19a) to (19c) are values defined as follows:

(a) $D_{INS}$ $D_{INS}$ is a value which depends on the input image data $D_{IN}^{k}$; $D_{INS}$ is given by the following expressions (21a) and (21b):

$$D_{INS}=D_{IN}^{k} \text{ (for } D_{IN}^{k}<D_{IN}^{Center}) \quad (21a)$$

$$D_{INS}=D_{IN}^{k}+1-K \text{ (for } D_{IN}^{k}>D_{IN}^{Center}) \quad (21b)$$

(b) $PD_{INS}$ $PD_{INS}$ is defined by the following expression (22a) with a parameter R defined by expression (22b):

$$PD_{INS}=(K-R)\cdot R \quad (22a)$$

$$R=K^{1/2}\cdot D_{INS}^{1/2} \quad (22b)$$

As understood from expressions (21a), (21b) and (22b), the parameter R is proportional to a square root of input image data $D_{IN}^{k}$ and therefore $PD_{INS}$ a value calculated by an expression including a term proportional to a square root of $D_{IN}^{k}$ and a term proportional to $D_{IN}^{k}$ (or one power of $D_{IN}^{k}$).

(c) $ND_{INS}$ $ND_{INS}$ is given by the following expression (23):

$$ND_{INS}=(K-D_{INS})\cdot D_{INS}. \quad (23)$$

As understood from expressions (21a), (21b) and (23), $ND_{INS}$ is a value calculated by an expression including a term proportional to a square of $D_{IN}^{k}$.

The output image data $D_{OUT}^{R}$, $D_{OUT}^{G}$ and $D_{OUT}^{B}$, which are calculated by the approximate gamma correction circuit 22 with the above-described series of expressions, are forwarded to the color reduction circuit 23. The color reduction circuit 23 performs a color reduction on the output image data $D_{OUT}^{R}$, $D_{OUT}^{G}$ and $D_{OUT}^{B}$ to generate the color-reduced image data $D_{OUT_D}$. The color-reduced image data $D_{OUT_D}$ are forwarded to the data line drive circuit 26 via the latch circuit 24 and the data lines 8 of the LCD panel 2 are driven in response to the color-reduced image data $D_{OUT_D}$.

As described above, occurrence of a halo effect is suppressed in the present embodiment, by performing an APL-calculating filtering process which involves setting the luminance value of the target pixel to a specific APL-calculation alternative luminance value in response to the differences of the luminance value of the target pixel from those of the pixels 9 near the target pixel in the original image. In detail, APL data of area characterization data associated with each area are calculated from an APL-calculation luminance image obtained by the APL-calculating filtering process. APL data of pixel-specific characterization data associated with a certain pixel 9 located in a certain area are calculated on the basis of the APL data of the area characterization data associated with the certain area, the APL data of the area characterization data associated with areas adjacent to the certain area, and the position of the certain pixel 9 in the area. The luminance values of pixels in an area in which changes in the luminance value are small are set to the APL-calculation alternative luminance value in the APL-calculation luminance image obtained by the APL-calculating filtering process, and accordingly APL data of area characterization data associated with adjacent two areas each of which includes a region in which changes in the luminance value are small are determined as close values. As a result, APL data of pixel-specific characterization data associated with the pixels 9 located in the adjacent two areas are also determined as close values. By determining the shape of the gamma curve (in the present embodiment, the gamma value) on the basis of the thus-determined APL data of the pixel-specific characterization data associated with each pixel 9, the shapes of the gamma curves are determined as similar for the pixels 9 located in the two areas, and this effectively suppresses occurrence of a halo effect.

In addition, occurrence of a halo effect is suppressed in the present embodiment by performing a square-mean-calculating filtering process which involves setting the luminance value of the target pixel to a specific square-mean-calculation alternative luminance value in response to the differences of the luminance value of the target pixel from those of the pixels 9 near the target pixel in the original image. In detail, square-mean data of area characterization data associated with each area are calculated from a square-mean-calculation luminance image obtained by the square-mean-calculating filtering process. Variance data of pixel-specific characterization data associated with a certain pixel 9 located in a certain area are calculated on the basis of the APL data and square-mean data of the area characterization data associated with the certain area, the APL data and square-mean data of the area characterization data associated with areas adjacent to the certain area, and the position of the certain pixel 9 in the area. The luminance values of pixels in an area in which changes in the luminance value are small are set to the square-mean-calculation alternative luminance value in the square-mean-calculation luminance image obtained by the square-mean-calculating filtering process, and accordingly variance data of area characterization data associated with adjacent two areas each of which includes a region in which changes in the luminance value are small are determined as close values. By determining the shape of the gamma curve (in the present embodiment, the gamma value) on the basis of the thus-determined variance data of the pixel-specific characterization data associated with each pixel 9, the shapes of the gamma curves are determined as similar for the pixels 9 located in the two areas, and this effectively suppresses occurrence of a halo effect.

Although the above-described embodiments recite that the gamma curves associated with each pixel 9 are modified on the basis of the variance data of the pixel-specific characterization data associated with each pixel 9 (that is, the correction point data CP1 and CP4 of the correction point data set $CP_sel^k$ are determined by modifying the correction point data CP1 and CP4 of the correction point data set $CP_L^k$ on the basis of the variance data of the pixel-specific characterization data associated with each pixel 9), the modification of the gamma curves based on the variance data of the pixel-specific characterization data associated with each pixel 9 may be omitted. In other words, step S16 may be omitted and the correction point data set $CP_L^k$ determined at step S15 may be used as the correction point data set $CP_sel^k$ without modification.

In this case, processes related to square-mean data and variance data may be omitted. That is, the square-mean data calculating filtering process at step S10, the calculation of variance data of area characterization data $D_{CHR_AREA}$ at step S11, the calculation of variance data of filtered characterization data $D_{CHR_FILTER}$ step S12 and the calculation of variance data of pixel-specific characterization data $D_{CHR_PIXEL}$ may be omitted. Such configuration also allows selecting gamma values suitable for individual areas and performing a correction calculation (gamma correction) with suitable gamma values, while suppressing the occurrence of a halo effect.

Although the above-described embodiments recite that gamma values $\gamma_PIXEL^R$, $\gamma_PIXEL^G$ and $\gamma_PIXEL^B$ are individually calculated for the R subpixel 11R, G subpixel 11G and B subpixel 11B of each pixel 9 and the correction calculation is performed depending on the calculated gamma values $\gamma_PIXEL^R$, $\gamma_PIXEL^G$ and $\gamma_PIXEL^B$, a common gamma value γ_PIXEL may be calculated for the R subpixel 11R, G subpixel 11G and B subpixel 11B of each pixel 9 to perform the same correction calculation.

In this case, for each pixel 9, a gamma value γ_PIXEL common to the R subpixel 11R, G subpixel 11G and B subpixel 11B is calculated from the APL data APL_PIXEL (y, x) associated with each pixel 9 in accordance with the following expression:

$$\gamma_PIXEL=\gamma_STD+APL_PIXEL(y,x)\cdot\eta, \quad (11a')$$

where γ_STD is a given reference gamma value and η is a given positive proportionality constant. Furthermore, a common correction point data set CP_L is determined from the gamma value γ_PIXEL. The determination of the correction point data set CP_L from the gamma value γ_PIXEL is achieved in the same way as the above-described determination of the correction point data set $CP_L^k$ (k is any of "R", "G" and "B") from the gamma value $\gamma_PIXEL^k$. Furthermore, the correction point data set CP_L is modified on the basis of the variance data $\sigma^2_PIXEL(y, x)$ associated with each pixel 9 to calculate a common correction point data set CP_sel. The correction point data set CP_sel is calculated in the same way as the correction point data set $CP_sel^k$ (k is any of "R", "G" and "B"), which is calculated by modifying the correction point data set $CP_L^k$ on the basis of the variance data $\sigma^2_PIXEL(y, x)$ associated with each pixel 9. For the input image data $D_{IN}$ associated with any of the R subpixel 11R, G subpixel 11G and B subpixel 11B of each pixel 9, the output image data $D_{OUT}$ are calculated by performing a correction calculation based on the common correction point data set CP_sel.

Is should be also noted that, although the above-described embodiments recite the liquid crystal display device 1 including the LCD panel 2, the present invention is applicable to various panel display devices including different display panels (for example, a display device including an OLED (organic light, emitting diode) display panel).

It would be apparent that the present invention is not limited to the above-described embodiments, which may be modified and changed without departing from the scope of the invention.

What is claimed:

1. A display device, comprising:

a display panel including a display region, wherein a plurality of areas are defined in the display region; and a driver configured to drive each pixel in the display region in response to input image data;

wherein the driver is configured to:

(1) generate APL-calculation image data corresponding to an APL-calculation luminance image by performing an APL-calculating filtering process on the input image data;

(2) calculate area characterization data including first APL data indicating an average picture level of each of the areas in the APL-calculation luminance image for each of the areas, from the APL-calculation image data;

(3) calculate second APL data for each pixel depending on a position of each pixel and the first APL data of the area characterization data associated with the area in which each pixel is located and with areas adjacent to the area in which each pixel is located, and generate pixel-specific characterization data including the second APL data for each pixel;

(4) generate output image data associated with each pixel by performing a correction calculation based on the second APL data of the pixel-specific image data associated with each pixel; and (5) drive each pixel in response to the output image data associated with each pixel, wherein the APL-calculating filtering process for a target pixel of the pixels in the display region comprises setting a luminance value of the target pixel in the APL-calculation luminance image to a specific APL-calculation alternative luminance value in response to differences of a luminance value of the target pixel from those of pixels near the target pixel in a luminance image corresponding to the input image data.

2. The display device according to claim 1, wherein, in the APL-calculating filtering process, a coefficient of change is calculated depending on the differences of the luminance value of the target pixel from those of pixels near the target pixels in the luminance image corresponding to the input image data, and the luminance value of the target pixel in the APL-calculation luminance image is calculated as a first weighted average of the APL-calculation alternative luminance value and the luminance value of the target pixel in the luminance image corresponding to the input image data, wherein a first weight given to the APL-calculation alternative luminance value in the calculation of the first weighted average and a second weight given to the luminance value of the target pixel in the luminance image corresponding to the input image data are determined depending on the coefficient of change.

3. The display device according to claim 1, wherein the driver is configured to generate square-mean-calculation)

image data corresponding to a square-mean-calculation luminance image by performing a square-mean-calculating filtering process on the input image data, wherein the area characterization data include square mean data indicating a mean of squares of luminance values of pixels in each of the areas in the square-mean-calculation luminance image, wherein the pixel-specific characterization data include first variance data which depend on the position of each pixel and the square-mean data of the area characterization data associated with the area in which each pixel is located and with areas adjacent to the area in which each pixel is located, wherein the driver determines a gamma value of a gamma curve for each pixel based on the second APL data of the pixel-specific characterization data associated with each pixel, performs an operation for modifying a shape of the gamma curve for each pixel, based on the first variance data of the pixel-specific characterization data associated with each pixel, and generates the output image data associated with each pixel by performing the correction calculation in accordance with the gamma curve with the modified shape, and wherein the square-mean-calculating filtering process for the target pixel comprises setting a luminance value of the target pixel in the square-mean-calculation luminance image to a specific square-mean-calculation alternative luminance value in response to differences of the luminance value of the target pixel from those of pixels near the target pixels in the luminance image corresponding to the input image data.

4. The display device according to claim 2, wherein the driver is configured to generate square-mean-calculation image data corresponding to a square-mean-calculation luminance image by performing square-mean-calculating filtering process on the input image data, wherein the area characterization data include square-mean data indicating a mean of squares of luminance values of pixels in each of the areas in the square-mean-calculation luminance image, wherein the pixel-specific characterization data include first variance data which depend on the position of each pixel and the square-mean data of the area characterization data associated with the area in which each pixel is located and with areas adjacent to the area in which each pixel is located, wherein the driver determines a gamma value of a gamma curve for each pixel based on the second APL data of the pixel-specific characterization data associated with each pixel, performs an operation for modifying a shape of the gamma curve for each pixel, based on the first variance data of the pixel-specific characterization data associated with each pixel, and generates the output image data associated with each pixel by performing the correction calculation in accordance with the gamma curve with the modified shape, and wherein the square-mean-calculating filtering process for the target pixel comprises setting a luminance value of the target pixel in the square-mean-calculation luminance image to a specific square-mean-calculation alternative luminance value in response to differences of the luminance value of the target pixel from those of pixels near the target pixels in the luminance image corresponding to the input image data.

5. The display device according to claim 4, wherein, in the square-mean calculating filtering process, the luminance value of the target pixel in the square-mean-calculation luminance image is calculated as a second weighted average of the square-mean-calculation alternative luminance value and the luminance value of the target pixel in the luminance image corresponding to the input image data, and wherein a first weight given to the square-mean-calculation alternative luminance value in the calculation of the second weighted average and a second weight given to the luminance value of the target pixel in the luminance image corresponding to the input image data are determined depending on the coefficient of change.

6. The display device according to claim 4, wherein each of the areas is rectangular, wherein, for each of vertices of the areas, the driver calculates third APL data based on the first APL data of the area characterization data associated with an area which each of the vertices belongs to, calculates second variance data based on the square-mean data of the area characterization data associated with the area which each of the vertices belongs to, generates filtered characterization data including the third APL data and the second variance data, and calculates the second APL data of the pixel-specific characterization data associated with each pixel based on the position of each pixel and the third APL data of the filtered characterization data associated with vertices of the area in which each pixel is located, and calculates the first variance data of the pixel-specific characterization data associated with each pixel based on the position of each pixel and the second variance data of the filtered characterization data associated with vertices of the area in which each pixel is located.

7. The display device according to claim 6, wherein the driver calculates the second APL data of the pixel-specific characterization data associated with each pixel by applying a linear interpolation based on the position of each pixel in the area in which each pixel is located to the third APL data of the filtered characterization data associated with the vertices of the area in which each pixel is located, and wherein the driver calculates the first variance data of the pixel-specific characterization data associated with each pixel by applying a linear interpolation based on the position of each pixel in the area in which each pixel is located to the second variance data of the filtered characterization data associated with the vertices of the area in which each pixel is located.

8. A display panel driver for driving each pixel in a display region of a display panel in response to input image date, wherein a plurality of areas are defined in the display region, the driver comprising:

an area characterization data calculation section operable to generate APL-calculation image data corresponding to an APL-calculation luminance image by performing an APL-calculating filtering process on the input image data, and calculates area characterization data including first APL data indicating an average picture level of each of the areas in the APL-calculation luminance image for each of the areas, from the APL-calculation image data;

a pixel-specific characterization data calculation section operable to calculate second APL data for each pixel depending on the position of each pixel and the first APL data of the area characterization data associated with the area in which each pixel is located and with areas adjacent to the area in which each pixel is located to generate pixel-specific characterization data including the second APL data for each pixel;

a correction circuitry operable to generate output image data associated with each pixel by performing a correction calculation based on the second APL data of the pixel-specific image data associated with each pixel; and a drive circuitry operable to drive each pixel in response to the output image data associated with each pixel, wherein the APL-calculating filtering process for a target pixel of the pixels in the display region comprises setting a luminance value of the target pixel in the APL-calculation luminance image to a specific APL-calculation alternative luminance value in response to differences of a luminance value of the target pixel from those of pixels near the target pixel in a luminance image corresponding to the input image data.

9. The display panel driver according to claim 8, wherein, in the APL-calculating filtering process, the area characterization data calculation section operable to calculate a coefficient of change depending on the differences of the luminance value of the target pixel from those of pixels near the target pixels in the luminance image corresponding to the input image data, and to calculate the luminance value of the target pixel in the APL-calculation luminance image as a first weighted average of the APL-calculation alternative luminance value and the luminance value of the target pixel in the luminance image corresponding to the input image data, and wherein a first weight given to the APL-calculation alternative luminance value in the calculation of the first weighted average and a second weight given to the luminance value of the target pixel in the luminance image corresponding to the input image data are determined depending on the coefficient of change.

10. The display panel driver according to claim 8, wherein the area characterization data calculation section is operable to generate square-mean-calculation image data corresponding to a square-mean-calculation luminance image by performing a square-mean-calculating filtering process on the input image data, wherein the area characterization data include square mean data indicating a mean of squares of luminance values of pixels in each of the areas in the square-mean-calculation luminance image, wherein the pixel-specific characterization data include first variance data which depend on the position of each pixel and the square-mean data of the area characterization data associated with the area in which each pixel is located and with areas adjacent to the area in which eaten pixel is located, wherein the correction circuitry determines a gamma value of a gamma curve for each pixel based on the second APL data of the pixel-specific characterization data associated with each pixel, performs an operation for modifying a shape of the gamma curve for each pixel, based on the first variance data of the pixel-specific characterization data associated with each pixel, and generates the output image data associated with each pixel by performing the correction calculation in accordance with the gamma curve with the modified shape, and wherein the square-mean-calculating filtering process for the target pixel comprises setting a luminance value of the target pixel in the square-mean-calculation luminance image to a specific square-mean-calculation alternative luminance value in response to differences of the luminance value of the target pixel from those of pixels near the target pixels in the luminance image corresponding to the input image data.

11. The display panel driver according to claim 9, wherein the area characterization data calculation section is operable to generate square-mean-calculation image data corresponding to a square-mean-calculation luminance image by performing square-mean-calculating filtering process on the input image data, wherein the area characterization data include square-mean data indicating a mean of squares of luminance values of pixels in each of the areas in the square-mean-calculation luminance image, wherein the pixel-specific characterization data include first variance data which depend on the position of each pixel and the square-mean data of the area characterization data associated with the area in which each pixel is located and with areas adjacent to the area in which each pixel is located, wherein the correction circuitry determines a gamma value of a gamma curve for each pixel based on the second APL data of the pixel-specific characterization data associated with each pixel, performs an operation for modifying a shape of the gamma curve for each pixel, based on the first variance data of the pixel-specific characterization data associated with each pixel, and generates the output image data associated with each pixel by performing the correction calculation in accordance with the gamma curve with the modified shape, and wherein the square-mean-calculating filtering process for the target pixel comprises setting a luminance value of the target pixel in the square-mean-calculation luminance image to a specific square-mean-calculation alternative luminance value in response to differences of the luminance value of the target pixel from those of pixels near the target pixels in the luminance image corresponding to the input image data.

12. The display panel driver according to claim 11, wherein, in the square-mean calculating filtering process, the area characterization data calculation section is operable to calculate the luminance value of the target pixel in the square-mean-calculation luminance image as a second weighted average of the square-mean-calculation alternative luminance value and the luminance value of the target pixel in the luminance image corresponding to the input image data, and wherein a first weight given to the square-mean-calculation alternative luminance value in the calculation of the second weighted average and a second weight given to the luminance value of the target pixel in the luminance image corresponding to the input image data are determined depending on the coefficient of change.

13. The display panel driver according to claim 11, wherein each of the areas defined in the display region is rectangular, wherein, for each of vertices of the areas, the pixel specific data calculation section is operable to calculate third APL data based on the first APL data of the area characterization data associated with an area which each of the vertices belongs to, to calculate second variance data based on the square-mean data of the area characterization data associated with the area which each of the vertices belongs to, to generate filtered characterization data including the third APL data and the second variance data, to calculate the second APL data of the pixel-specific characterization data associated with each pixel based on the position of each pixel and the third APL data of the filtered characterization data associated with vertices of the area in which each pixel is located, and to calculate the first variance data of the pixel-specific characterization data associated with each pixel based on the position of each pixel and the second variance data of the filtered characterization data associated with vertices of the area in which each pixel is located.

14. The display panel driver according to claim 13, wherein the pixel-specific characterization data calculation section is operable to calculate the second APL data of the pixel-specific characterization data associated with each pixel by applying a linear interpolation based on the position of each pixel in the area in which each pixel is located to the third APL data of the filtered characterization data associated with the vertices of the area in which each pixel is located, and wherein the pixel-specific characterization data calculation section calculates the first variance data or the pixel-specific characterization data associated with each pixel by applying a linear interpolation based on the position or each pixel in the area in which each pixel is located to the second variance data or the filtered characterization data associated with the vertices of the area in which each pixel is located.

15. A display panel drive method for driving each pixel in a display region of a display panel in response to input image data, the method comprising:

generating APL-calculation image data corresponding to an APL-calculation luminance image by performing an APL-calculating filtering process on the input image data;

calculating area characterization data including first APL data indicating an average picture level of each of the areas in the APL-calculation luminance image for each of the areas, from the APL-calculation image data;

calculating second APL data for each pixel depending on the position of each pixel and the first APL data of the area characterization data associated with the area in which each pixel is located and with areas adjacent to the area in which each pixel is located to generate pixel-specific characterization data including the second APL data for each pixel;

generating output image data associated with each pixel by performing a correction calculation based on the second APL data of the pixel-specific image data associated with each pixel; and driving each pixel in response to the output image data associated with each pixel, wherein the APL-calculating filtering process for a target pixel of the pixels in the display region comprises setting a luminance value of the target pixel in the APL-calculation luminance image to a specific APL-calculation alternative luminance value in response to differences of a luminance value of the target pixel from those of pixels near the target pixel in a luminance image corresponding to the input image data.

16. The drive method according to claim 15, further comprising:

generating square-mean-calculation image data corresponding to a square-mean-calculation luminance image by performing a square-mean-calculating filtering process on the input image data, wherein the area characterization data include square mean data indicating a mean of squares of luminance values of pixels in each of the areas in the square-mean-calculation luminance image, wherein the pixel-specific characterization data include first variance data which depend on the position of each pixel and the square-mean data of the area characterization data associated with the area in which each pixel is located and with areas adjacent to the area in which each pixel is located, and wherein generating the output image data comprises:

determining a gamma value of a gamma curve for each pixel based on the second APL data of the pixel-specific characterization data associated with each pixel; and performing an operation for modifying a shape of the gamma curve for each pixel, based on the first variance data of the pixel-specific characterization data associated with each pixel, and wherein the square-mean-calculating filtering process for the target pixel comprises setting a luminance value of the target pixel in the square-mean-calculation luminance image to a specific square-mean-calculation alternative luminance value in response to differences of the luminance value of the target pixel from those of pixels near the target pixels in the luminance image corresponding to the input image data.

* * * * *